US011754261B2

(12) United States Patent
Smets

(10) Patent No.: US 11,754,261 B2
(45) Date of Patent: Sep. 12, 2023

(54) LUMINAIRE SYSTEM WITH CONVERTED MOVEMENT

(71) Applicant: Schreder S.A., Brussels (BE)

(72) Inventor: Paul Smets, Liege (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/414,066

(22) PCT Filed: Dec. 24, 2019

(86) PCT No.: PCT/EP2019/087023
§ 371 (c)(1),
(2) Date: Jun. 15, 2021

(87) PCT Pub. No.: WO2020/136203
PCT Pub. Date: Jul. 2, 2020

(65) Prior Publication Data

US 2022/0057072 A1 Feb. 24, 2022

(30) Foreign Application Priority Data

Dec. 24, 2018 (NL) ..... 2022294

(51) Int. Cl.
*F21V 17/02* (2006.01)
*F21V 14/06* (2006.01)
(Continued)

(52) U.S. Cl.
CPC ..... *F21V 17/02* (2013.01); *F21V 5/007* (2013.01); *F21V 14/02* (2013.01); *F21V 14/06* (2013.01);
(Continued)

(58) Field of Classification Search
CPC ..... F21V 5/007; F21V 14/06; F21V 17/02; F21V 14/02; F21Y 2105/16; F21Y 2115/10; F21W 2131/103
See application file for complete search history.

(56) References Cited

U.S. PATENT DOCUMENTS

2011/0134649 A1* 6/2011 Becker ..... F21V 5/007 362/326
2012/0121244 A1* 5/2012 Stavely ..... G02B 3/08 362/232
(Continued)

FOREIGN PATENT DOCUMENTS

DE 202013101824 U1 7/2014
DE 202015102145 U1 8/2016
(Continued)

OTHER PUBLICATIONS

PCT International Search Report and Written Opinion, Application No. PCT/EP2019/087023, dated Mar. 16, 2020, 10 pages.

*Primary Examiner* — Erin Kryukova
(74) *Attorney, Agent, or Firm* — McDonnell Boehnen Hulbert & Berghoff LLP

(57) ABSTRACT

Example embodiments relate to luminaire systems with converted movements. The luminaire system includes a first support. The luminaire system also includes a second support movable with respect to the first support. Additionally, the luminaire system includes a moving means configured for moving the second support relative to the first support in a movement plane substantially parallel to the first support. The moving means includes a rotatable element provided to one of the first support or second support and configured for rotating around a rotation axis perpendicular to the movement plane. The rotatable element includes a first conversion portion cooperating with a second conversion portion. The first and second conversion portion are configured for con-
(Continued)

verting a rotational movement of the rotatable element into a movement of the second support with respect to the first support in said movement plane.

18 Claims, 9 Drawing Sheets

(51) Int. Cl.

| | |
|---|---|
| ***F21V 14/02*** | (2006.01) |
| ***F21V 5/00*** | (2018.01) |
| ***F21Y 105/16*** | (2016.01) |
| ***F21Y 115/10*** | (2016.01) |
| ***F21W 131/103*** | (2006.01) |

(52) U.S. Cl.
CPC .... *F21W 2131/103* (2013.01); *F21Y 2105/16* (2016.08); *F21Y 2115/10* (2016.08)

(56) References Cited

U.S. PATENT DOCUMENTS

| | | | | |
|---|---|---|---|---|
| 2014/0085886 | A1 | 3/2014 | Kothmeier | |
| 2018/0087748 | A1 | 3/2018 | Gladden et al. | |
| 2019/0017680 | A1* | 1/2019 | Rasmussen | F21V 14/06 |
| 2019/0203909 | A1* | 7/2019 | Heemstra | G02B 26/08 |
| 2021/0348740 | A1* | 11/2021 | Bory | G02B 26/0833 |

FOREIGN PATENT DOCUMENTS

| | | | | |
|---|---|---|---|---|
| DE | 202015102145 | U1 * | 9/2016 | F21V 14/06 |
| EP | 2602536 | A1 | 6/2013 | |
| EP | 3088799 | A1 * | 11/2016 | F21V 14/06 |
| EP | 3239591 | A1 * | 11/2017 | |
| FR | 3049685 | A1 | 10/2017 | |
| WO | WO-2007007271 | A2 * | 1/2007 | F21V 14/06 |
| WO | WO-2018028926 | A1 * | 2/2018 | F21V 17/005 |

* cited by examiner

LUMINAIRE SYSTEM WITH CONVERTED MOVEMENT

CROSS-REFERENCE TO RELATED APPLICATIONS

The present application is a national stage entry of PCT/EP2019/087023 filed Dec. 24, 2019, which claims priority to NL 2022294 filed Dec. 24, 2018, the contents of each of which are hereby incorporated by reference.

FIELD OF INVENTION

The present invention relates to luminaire systems. Particular embodiments of the invention relate to a luminaire system with adjustable photometry.

BACKGROUND

Currently, in the luminaire production, it is necessary to design a specific printed circuit board (PCB) serving as a support for light sources together with a specific optical element type and shape for each luminaire application, e.g. pedestrian road, highway, one-way road, etc. The overall design depends notably on the desired lighting pattern on the surface to be illuminated, i.e. the desired shape of the light onto the illuminated surface. Such approach is costly, time consuming, and requires extensive stock keeping. It would therefore be advantageous to be able to design a luminaire system with a more adaptive approach for which the photometry can be modified on site and/or at the factory, depending on the application and the desired light distribution.

Several solutions exist for outdoor lighting equipment presenting optical elements adjustable on an individual basis or within relatively restricted boundaries. However, the flexibility of use of the luminaire systems remains limited and there is a need for a luminaire system which can be adapted to each site and desired usage.

SUMMARY

The object of embodiments of the invention is to provide a luminaire system whose light distribution can be varied and which is more adaptable to a site to be illuminated and/or to a specific application. More in particular embodiments of the invention aim to provide a luminaire system for which the photometry can be adjusted on site and/or at the factory.

According to a first aspect of the invention, there is provided a luminaire system. The luminaire system comprises:

- a first support;
- a second support movable with respect to said first support;
- a moving means configured to move the second support relative to the first support in a movement plane substantially parallel to the first support;
- wherein the moving means comprises:
  - a rotatable element provided to one of the first support or second support and configured for rotating around a rotation axis perpendicular to the movement plane; and wherein the rotatable element comprises a first conversion portion cooperating with a second conversion portion, said second conversion portion being provided to the other one of the first support or second support;

- wherein the first and second conversion portion are configured for converting a rotational movement of the rotatable element into a movement of the second support with respect to the first support in said movement plane;
- wherein a plurality of light sources is arranged on one of the first support and the second support, and is configured to emit light through one or more optical elements associated with the plurality of light sources and arranged on the other one of the first support and the second support.

A common solution to adapt a luminaire system to a specific use or site is to mount optical elements specified for the corresponding use or site. Installing different optical elements depending on the site and/or desired use makes the installation task unnecessarily complicated. Moreover it adds the disadvantage of having to store several optical element types for production and/or for maintenance. This problem is overcome by a luminaire system as defined above.

The light emitted by the plurality of light sources arranged on one of the first support and second support will be influenced in a certain manner by the one or more optical elements comprised on the other one of the first support and the second support and associated with the plurality of light sources. Having the plurality of light sources and the one or more optical elements on different supports allows making independent the positioning of one with respect to the other. Indeed, the moving means will allow altering their relative positioning. In such a way, the emitted light and its distribution may be correlated to different relative positions of the one or more optical elements with respect to the positions of the plurality of light sources. The light distribution of the luminaire system can be adapted more easily to different sites and/or applications without having to mount different optical components. More in particular, embodiments of the invention allow a dynamic adaptation of the light distribution of the luminaire system based, for example, on changes occurring in its environment. By light distribution, it is meant the light envelope in space, formed by the light emitted by the plurality of light sources through the one or more optical elements, and which represents the emission directions and the intensity variations of the light through the one or more optical elements.

Moreover, by having the moving means comprising a first and second conversion portions, the actuation of the moving means may be redirected towards a more favourable location. The more favourable location may be, for example, a location outside a luminaire head of the luminaire system reachable by an operator or by a user, a location outside a compartment inside a luminaire head, or may be a location of another component linked to the moving means inside the luminaire head of the luminaire system. Advantageously, the moving means requires less space in the luminaire system. Since the first conversion portion is comprised by a rotatable element, a potentially complex movement of the first support relative to the second support or a simpler movement, e.g. a translation, is transposed simply into a rotational movement. Rotational movement can be controlled reliably and precisely to achieve the desired illumination from the luminaire system.

Preferably, the first support is fixed in the luminaire system and the movement of the second support relative to the first support is controlled through the rotational element of the moving means.

Preferably, the luminaire system is included in a luminaire head. The first support may be fixed in the luminaire system, preferably in said luminaire head. This arrangement allows heat dissipation of the first support via thermal contact with the luminaire head. Alternatively, the first support may move in the luminaire system independently from the movement of the second support relative to the first support.

Preferred embodiments relate to a luminaire system of an outdoor luminaire. By outdoor luminaire, it is meant luminaires which are installed on roads, tunnels, industrial plants, campuses, parks, cycle paths, pedestrian paths, or in pedestrian zones for example, and which can be used notably for the lighting of an outdoor area, such as roads and residential areas in the public domain, private parking areas and access roads to private building infrastructures, etc.

According to a preferred embodiment, the first support comprises said plurality of light sources and the second support comprises one or more optical elements associated with the plurality of light sources.

The one or more optical elements may be one or more lens elements. In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and a collimator portion integrally formed with said lens portion, said collimator portion being configured for collimating light transmitted through said lens portion. Also, a lens element may be provided with a reflective portion or surface or with a diffusive portion.

Alternatively, the one or more optical elements could be a transparent or translucent cover having varying optical properties (e.g. variation of thickness, transparency, diffusivity, reflectivity, refractivity, color, etc.) along the movement direction.

In this way, the first support comprising said plurality of light sources is fixed in the luminaire system, and the second support comprising said one or more optical elements moves relative to the first support. This arrangement allows heat dissipation of the first support via thermal contact with a heat dissipative surface part of the luminaire system.

The movement of the second support relative to the first support in the movement plane may be a translational movement along one translational axis in a plane parallel to the surface of the first support or may be a more complex movement, e.g. zig-zag, S-shaped, curved, along an acute angle, simultaneously with a rotational movement.

In another exemplary embodiment, there may be a first and a second moving means configured for converting movements as described above, said first moving means being configured to move the second support relative to the first support along a first trajectory in the movement plane substantially parallel to the first support, and said second moving being configured to move, independently from the first moving means, the second support relative to the first support along a second trajectory in the movement plane substantially parallel to the first support.

In yet another exemplary embodiment, in addition to the moving means, the luminaire system may comprise an elevating means configured to change the elevation of the second support relative to the first support. A plurality of spring elements may be arranged between the first and second supports to maintain the second support substantially parallel to the first support.

According to an exemplary embodiment, the rotatable element extends through the second support, and the rotation axis is fixed with respect to the first support.

In this manner, the footprint of the rotatable element and the associated first conversion portion is comprised in the footprint of the first support which saves space. Moreover, for one support to move respective to the other, one of the first or second conversion portions needs to be fixed with respect to that support. Preferably, the first support is fixed in the luminaire system and the rotational movement of the rotatable element is stabilized by having its rotation axis fixed with respect to the first support. In one embodiment, the rotatable element is fixed to a housing portion of the luminaire system. In another embodiment, the rotatable element is fixed directly to the first support.

According to a preferred embodiment, the luminaire system further comprises one or more positioning elements; and the moving means is configured for cooperating with the one or more positioning elements to position the second support with respect to the first support in a plurality of predetermined positions.

In this way, the second support is positioned relative to the first support at known positions that are correlated to different arrangements of the second support relative to the first support. It has the advantage that predetermined arrangements can be achieved reliably, which in turn saves time during the setting of the luminaire system. The one or more positioning elements allows precise and stable positioning of the moving means. Preferably, the one or more positioning elements allows setting the rotatable element in a specific position. The skilled person will understand that the one or more positioning elements may be implemented in or on a large variety of parts of the luminaire system, e.g. housing, first support, second support, moving means, actuator.

The one or more positioning elements may be discrete positioning elements or continuous positioning elements. Discrete positioning elements allow positioning the moving means at given predetermined positions with high accuracy and high repeatability. Examples of discrete positioning elements may be dips and/or bumps placed at regular intervals on a surface. Continuous positioning elements allow changing the positioning of the moving means in infinitesimally small steps which provides high tunability of the arrangement of the second support with respect to the first support. Examples of continuous positioning elements may be ramp elements, spiral-shaped elements, linear or circular channels, and the like.

Additionally, marks may be associated to the one or more positioning elements as a visual aid to the operator to determine the position of the moving means. Examples of marks may be letters, numbers, symbols, a scale. The marks may be provided to the actuator and/or the moving means and/or on the first and/or on the second support.

According to an exemplary embodiment, the one or more positioning elements is configured such that the plurality of predetermined positions corresponds with a plurality of lighting patterns on a surface, said plurality of lighting patterns having a plurality of different illuminated surface areas.

In this manner, the second support is positioned relative to the first support at known positions that are correlated to different light distributions resulting in different lighting patterns. The luminaire system is adaptable to a plurality of environments and/or applications matched with the plurality of lighting patterns. The plurality of lighting patterns may be systematically linked to the one or more positioning elements to be easily set by the operator.

According to a preferred embodiment, the one or more positioning elements comprises one or more depressions or protuberances cooperating with at least one corresponding depression or protuberance provided to the moving means.

In this way, the one or more positioning elements is implemented through a simple mechanical means via cooperating shapes. In one embodiment, the one or more positioning elements is assisted by a spring to increase the force necessary to move from a first position to a second position and thereby increasing the positioning stability. The one or more positioning elements may be one or more depressions configured to cooperate with at least one protuberance, or the one or more positioning elements may be one or more of protuberances configured to cooperate with at least one depression.

Alternatively the one or more positioning elements may be one or more protuberances configured to cooperate with a pair of protuberances designed to be located on either side of a protuberance of the one or more protuberances.

In yet another exemplary embodiment, the one or more positioning elements may comprise magnet elements and/or ferromagnetic material configured to electromagnetically retain the moving means in the plurality of predetermined positions. The one or more magnet elements and/or ferromagnetic materials may be configured to cooperate with a corresponding positioning member of the rotatable element comprising a magnet element and/or a ferromagnetic material.

According to an exemplary embodiment, the one or more depressions or protuberances is provided in or on the first or second support.

In this manner, the one or more positioning elements are designed as part of the first or second support which reduces the size and number of parts of the moving means.

According to a preferred embodiment, the luminaire system comprises a guiding means configured for guiding the movement of the second support with respect to the first support.

In this way, the movement of the second support is further controlled along a trajectory substantially parallel to the first support, which results in a greater accuracy of the positioning of the optical elements respective to the light sources, or of the positioning of the light sources respective to the optical elements. In yet another exemplary embodiment, the movement of the second support with respect to the first support may include a displacement being simultaneously or alternately along two perpendicular axes of the movement plane and the guiding means may comprise a plurality of guiding members configured for guiding the second support with respect to the first support along the two perpendicular axes.

According to an exemplary embodiment, the guiding means comprises a first sliding guide and a second sliding guide at opposite side edges of the first or second support. Alternatively one of the first and second sliding guides may be arranged on the first support, and the other one of the first and second sliding guides may be arranged on the second support.

This arrangement facilitates the guiding of the movement of the second support relative to the first support.

According to an exemplary embodiment, the guiding means is further configured to guide the movement of the second support with respect to the first support along a combination of said first trajectory and said second trajectory. For example, a plurality of square or star/cross-shaped slits may be arranged in the second support, and the guiding means may comprise guiding elements extending through said square or star/cross-shaped slits and fixed to the first support and/or to a fixed component of the luminaire system.

According to a preferred embodiment, the guiding means is integrally formed with the first and/or second support.

In this way, fewer parts are needed to form the guiding means. It facilitates the assembly of the luminaire system and can save space. It can also facilitate the manufacturing of the first or second support, especially if it is achieved through a moulding process.

According to an exemplary embodiment, the guiding means comprises a plurality of elongated guiding holes located in the first or second support.

In this manner, the guiding means is implemented in a simple manner Additionally, fixation means used to assemble the first and second support, either to each other or both to the luminaire head, can pass through the plurality of guiding holes which serves the double purpose of guiding and fixation.

According to a preferred embodiment, the movement of the second support with respect to the first support is a translational movement.

In this way, the relationship between the first conversion portion and the second conversion portion is mechanically simpler since the moving means transposes a rotation into a translation. It enables a better control of the movement of the second support relative to the first support and an improved predictability of the lighting pattern resulting from the emission of light through the optical elements. Preferably, the one or more optical elements have varying optical properties, e.g. transparency, diffusivity, reflectivity, and/or refractivity, in a direction parallel to the translational movement of the second support.

According to an exemplary embodiment, the second support is arranged substantially parallel to the first support.

In this manner, the second support is positioned at a similar distance from the first support in the movement plane. The plurality of light sources provided to the first support is thus at a similar distance from the plurality of optical elements of the second support; the plurality of lighting patterns resulting from the light emitted through the plurality of optical elements is more easily predictable. Additionally, the assembly of the second support relative to the first support is improved due to the standard substantially parallel arrangement.

According to a preferred embodiment, the second support is arranged to move in contact with the first support.

In this way, the assembly of the second support relative to the first support is improved. The contact of the first and second support adds a guiding surface to the movement of the second support relative to the first support. Additionally, the plurality of light sources is at a known distance from the optical elements of the second support which improves the uniformity of the light distribution and the predictability of the plurality of lighting patterns emitted by the luminaire system.

Also, the distance between the first support and the second support is zero and fixed, which allows for a better determination of the expected light distribution corresponding to different positions of the second support with respect to the first support. In another embodiment, the second support is arranged to move at a predetermined distance from the first support. To that end, the first support may be provided with distance elements on which the second support is movably supported. Optionally, a surface of the second support facing the first support, or a surface of the first support facing the second support, may be provided with tracks or guides cooperating with the distance elements. Such tracks or guides may be formed integrally with the rest of the second support, or with the rest of the first support, respectively. Optionally, the distance elements may be adjustable in order to adjust the distance between the first support and the second support. For example, the distance elements may comprise a screw thread cooperating with a bore arranged in/on the first or second support.

According to an exemplary embodiment, the first conversion portion comprises a circular gear element portion, and the second conversion portion comprises a linear gear element portion cooperating with the circular gear element portion.

In this manner, the rotation movement of the rotatable element is transferred via the interconnection of teeth comprised in the circular gear element portion and in the linear gear element portion which allows a safe movement conversion without any substantial slippage. The manufacturing of gear elements may be achieved via, for example injection moulding, casting, transfer moulding, overmoulding, or in another appropriate manner, and the design parameters of the gear elements can be modified in function of the desired movement range, movement precision, conversion inaccuracies, and movement trajectory. In one embodiment, the circular gear element may be a cylindrical portion of the rotatable element with teeth provided to the circumference of the cylindrical portion. In another embodiment, the teeth are only provided to a section of the circumference of the cylindrical portion of the rotatable element.

According to a preferred embodiment, the linear gear element extends along the movement direction of the moving means.

In this way, the linear gear element acts as an additional guiding means to the movement of the second support relative to the first support. Additionally, the design of the linear gear element is made simpler.

According to an exemplary embodiment, the first conversion portion comprises an eccentric element, and the second conversion portion comprises a guiding element cooperating with the eccentric element.

In this manner, the conversion of the rotational movement into the movement of the second support is achieved through shape constraints. The first and second conversion portions can be designed and manufactured simply. Due to the simplicity of the shapes involved, maintenance is lighter and fabrication is less impacted by tolerances.

According to a preferred embodiment, the guiding element extends in a direction perpendicular to a movement direction of the second support.

In this way, a rotational movement of the eccentric element is clearly divided into a movement along the direction of the guiding means and into a translational movement along the guiding element. The movement of the second support relative to the first support is thus easily derived from a known rotation of the eccentric element.

According to an exemplary embodiment, the guiding element comprises a hole in the second support within which a portion of the eccentric element is located, and the plurality of elongated guiding holes is extending in a direction perpendicular to the extending direction of the hole of the guiding element.

In this manner, the rotational movement of the eccentric element is clearly divided along two perpendicular axes. The integration of the guiding element in the second support allows decreasing the number of parts required to implement the second conversion portion.

According to a preferred embodiment, the second support is arranged such that an optical element of the one or more optical elements extends over a corresponding light source of the plurality of light sources.

In this way, each light source of the plurality of light source has a light distribution patterned by a corresponding optical element, which provides a large range of flexibility with respect to the final lighting pattern emitted by the luminaire system.

According to an exemplary embodiment, the second support comprises an optical plate integrating the one or more optical elements, and optionally a frame, wherein the optical plate is carried by the frame. Also, the frame may carry multiple optical plates together integrating the plurality of optical elements. According to another exemplary embodiment, the frame may comprise a surrounding fixture and a plurality of crossing elements extending between edges of the surrounding fixture. When multiple optical plates are carried by the frame, the crossing elements may extend along adjacent edges of two adjacent lens plates. In another embodiment, the second support may be the optical plate without a frame. For example, when the optical plate is sufficiently rigid, it may be used without a frame. In yet another embodiment, the plurality of optical elements may be separately formed and the second support may comprise a frame carrying the plurality of optical elements.

In this manner, the optical elements can be more easily replaced in case on maintenance. Also, the moving of the optical plate/optical elements may be more easily achieved.

According to a preferred embodiment, the one or more optical elements comprise a plurality of lens elements associated with the plurality of light sources.

In this way, the light distribution of the light emitted by the associated light source may be precisely and uniformly shaped as well as providing a protection to the associated light source. Lens elements may be typically encountered in outdoor luminaire systems, although other types of optical elements may be additionally or alternatively present in such luminaire systems, e.g. reflector, backlight, collimator, diffusor, and the like.

Additionally, the one or more optical elements may further comprise one or more light shielding structures complying with different glare classifications, e.g. the G classification defined according to the CIE115:2010 standard, the G* classification defined according to the EN13201-2 standard. The light shielding structures may be configured for reducing a solid angle of light beams of the plurality of light sources by cutting off or reflecting light rays having a large incident angle, thereby reducing the light intensities at large angles and improving the G/G* classification of the luminaire system. The one or more optical elements may comprise on the one hand a lens plate comprising a plurality of lenses covering the plurality of light sources, and on the other hand one or more light shielding structures mounted on said lens plate. In such an embodiment, the lens plate and the one or more shielding structures form a second support which is movable relative to the first support.

In one embodiment, the light shielding structures may comprise a plurality of closed reflective barrier walls, each having an interior bottom edge disposed on said flat portion, an interior top edge at a height above said flat portion, and a reflective surface connecting the interior bottom edge and the interior top edge and surrounding one or more associated lenses of said plurality of lenses. The height may be at least 2 mm, preferably at least 3 mm. The interior bottom edge defines a first closed line and the interior top edge defines a second closed line. Preferably, the first closed line and said second closed line comprising at least one curved portion over at least 15%, preferably over at least 20%, more preferably over at least 25%, of a perimeter of said first closed line and a perimeter of said second closed line, respectively. The reflective surface is configured for reducing a solid angle Ω of light beams emitted through the one or more associated lenses of said plurality of lenses. Exemplary embodiments of shielding structures are disclosed in patent application NL2023295 in the name of the applicant which is included herein by reference.

In another embodiment, the light shielding structures may comprise a plurality of reflective barriers, each comprising a base surface disposed on said flat portion, a top edge at a height above said base surface, and a first reflective sloping surface connecting the base surface and the top edge and facing one or more associated lenses of said plurality of lenses. The first reflective sloping surface may be configured for reflecting light rays emitted through one or more associated first lenses of said plurality of lenses having a first incident angle with respect to an axis substantially perpendicular to the base surface between a first predetermined angle and 90°, with a first reflection angle with respect to said axis smaller than 60°. The first predetermined value may be a value below 90°. In other words, when the first incident angle is between the first predetermined value and 90°, the first reflective sloping surface reflects the incident ray such that the reflected ray has a reflection angle with respect to said axis smaller than 60°. According to an embodiment, at least one reflective barrier of the plurality of reflective barriers further comprises a second reflective sloping surface opposite the first reflective sloping surface, configured for reflecting light rays emitted through one or more associated second lenses of said plurality of lenses adjacent to the one or more first lenses associated with the first reflective sloping surface, having a second incident angle with respect to an axis substantially perpendicular to the base surface comprised between a second predetermined angle and 90°, with a second reflection angle with respect to said axis smaller than 60°. Exemplary embodiments of shielding structures are disclosed in patent application PCT/EP2019/074894 in the name of the applicant which is included herein by reference.

According to an exemplary embodiment, a lens element of the plurality of lens elements has a first surface and a second surface located on opposite sides thereof, wherein the first surface is a convex or planar surface and the second surface is a concave or planar surface facing a light source of the plurality of light sources.

In this manner, the light source placed at the second surface side of the lens element has its emitted light being spread. The shape of the lens element and position of the lens element with respect to the light source will influence the distribution and intensity profile of light.

According to a preferred embodiment, an optical element of the plurality of optical elements, e.g. a lens element, has an internal dimension D seen in the movement direction of the moving means; and the moving means is configured to move the second support with respect to the first support over a distance below 90% of the internal dimension D of the optical element, preferably below 50% of the internal dimension D of the optical element.

In another embodiment, the controlling of the moving is such that the second support is moved relative to the first support in such a way that a given light source is moving from one optical element to another optical element.

In this way, changes in the light distribution are achieved by changes in the profile or optical properties of the optical element in the direction of movement. Movements would only need to be limited such that the light emitted by the plurality of light sources is distributed in an adequate manner by the corresponding optical elements. The mentioned adequate manner can correspond to a movement whose distance is below 90%, preferably below 50%, of the internal dimension D of the optical element such that the plurality of light sources can be kept in correspondence with their respective optical elements. In another embodiment, the luminaire system comprises more optical elements (e.g. lens elements) than light sources, and the controlling means is configured to control the moving means such that the second support is moved relative to the first support in such a way that a given light source is moved from one optical element to another optical element.

According to an exemplary embodiment, a lens element of the plurality of lens elements has an internal surface facing a light source of the plurality of light sources and an external surface. The internal surface and/or the external surface may comprise a first curved surface and a second curved surface, said first curved surface being connected to said second curved surface through a connecting surface or line comprising a saddle point or discontinuity. The second support is movably arranged relative to the first support to position the light source either in a first position facing the first curved surface or in a second position facing the second curved surface. When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from an associated light source. An outwardly bulging external surface forms a protruding portion, whilst an outwardly bulging internal surface forms a cavity facing an associated light source.

By providing such curved surfaces, the lens element is given a "double bulged" shape allowing to generate distinct lighting patterns depending on the position of the light source with respect to the lens element. More in particular, the shape, the size and the location of the light beam may be different depending on the position of the light source with respect to the lens element. This will allow illuminating various types of roads or paths with the same luminaire head. Also, this will allow adjusting a lighting pattern in function of the height above the surface to be illuminated.

Preferably, each lens element has a circumferential edge in contact with the first/second support, and the internal connecting surface or line is at a distance of the first/second support, depending on which one of the first support and the second support comprises the lens elements.

Preferably, the first outwardly bulging surface and the first/second support delimit a first internal cavity, the second outwardly bulging surface and the first/second support delimit a second internal cavity, and the internal connecting surface or line and the first/second support delimit a connecting passage between the first and second internal cavity. Such a connecting passage will allow a light source to pass from the first to the second cavity and vice versa. Preferably, a first maximal width (w1) of the first internal cavity, and a second maximal width (w2) of the second internal cavity are bigger than a third minimal width (w3) of the connecting passage between the first and second internal cavity. The first and second maximal width and the third minimal width extend in the same plane, preferably an upper plane of the first/second support, in a direction perpendicular on the moving direction. The first and second maximal width may also be different. The widths are measured in a lower plane of the lens element, delimiting the open side of the cavities, and the maximum corresponds with a maximum in this plane. When the lens element is supported on the first support, this plane corresponds with a surface of the first support.

Preferably, the first curved surface is at a first maximal distance of the first/second support, the second curved surface is at a second maximal distance of the first/second support, and the saddle point or discontinuity is at a third minimal distance of the first/second support, said third minimal distance being lower than said first and second maximal distance. More preferably, the first and second maximal distance are different. Those characteristics may apply for the external and/or internal curved surfaces.

In an exemplary embodiment, the luminaire head has a fixation end configured for being attached to a pole, the first maximal distance defined above is larger than the second maximal distance defined above, and the lens element is arranged such that the first internal and/or external curved surface is closer to the fixation end of the luminaire head than the second internal and/or external curved surface.

In an exemplary embodiment, the lens element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, wherein the second edge is an edge near the connecting surface or line and the first edge is opposite the second edge, away from the connecting surface or line. Alternatively or additionally, the light source may be provided with a reflective element. Using one or more reflective elements, light may be directed to the street side of the luminaire in a more optimal manner.

The first and/or second curved surfaces may have a symmetry axis parallel to the moving direction. In exemplary embodiments, both the first and second curved surfaces may have a symmetry axis parallel to the moving direction. However, it is also possible to design the first curved surfaces with a symmetry axis whilst giving the second curved surfaces an asymmetric design or vice versa, or to design both the first and the second curved surfaces in an asymmetric manner. This will allow to obtain a symmetrical light beam in at least a first position of the light source relative to the lens element, and to obtain an asymmetrical light beam in at least a second position of the light source relative to the lens element.

In the examples above a lens element comprises two adjacent curved surfaces bulging outwardly, but the skilled person understands that the same principles can be extended to embodiment with three or more adjacent curved surfaces bulging outwardly. Also, it is possible to provide a lens element with an array of bulged surfaces, e.g. an array of n×m bulged surfaces with n>=1 and m>=1.

According to an exemplary embodiment, the luminaire system further comprises a driver configured for driving the plurality of light sources, and optionally, comprises a dimmer configured to control the driver to drive one or more of the plurality of light sources at a dimmed intensity.

In this manner, the energy supplied to the plurality of light sources is controlled by the driver. The optional addition of a dimmer would allow obtaining a greater variety of light distributions by varying the light intensity and/or the light colour and/or the light colour temperature in addition to the positioning of the plurality of light sources respective to the plurality of optical elements. Preferably, the plurality of light sources is a plurality of LEDs.

According to a preferred embodiment, the plurality of light sources is arranged in a two-dimensional array of at least two rows and at least two columns.

In this way, the mounting and connecting of the plurality of light sources on the first support or the second support is simplified. Similarly, the one or more optical elements may be arranged in a two-dimensional array of at least two rows and at least two columns. Further, different light sources may be arranged on the first/second support. For example, said light sources may have different colours or different colour temperatures. Further, different optical elements may be arranged on the second/first support, respectively. For example, said optical elements may have different shapes, or may comprise a transparent or translucent cover having different optical properties (e.g. differences of thickness, transparency, diffusivity, reflectivity, refractivity, colour, colour temperature, etc.) along the movement direction of the second support.

According to an exemplary embodiment, the moving means further comprises an actuation element configured for being actuated such that the rotational movement of the rotatable element is achieved.

In this manner, the moving means can be coupled to an actuator to perform the movement of the rotatable element. The actuation by an actuator can be motorized or manual.

According to a preferred embodiment, the actuation element comprises a ferromagnetic material arranged such that the actuation element can be moved by means of a magnet element arranged outside a compartment of the luminaire system, or vice versa.

In this way, the mechanism of the moving means is protected inside the compartment of luminaire system and can be actuated remotely. The compartment may be a compartment inside the luminaire head or may be the housing of the luminaire head According to an exemplary embodiment, the luminaire system further comprises a stopping means configured to stop the movement of the second support with respect to the first support past a predetermined point along at least one movement direction of the moving means.

In this manner, the movement of the second support relative to the first support is safeguarded against manipulation mistakes during the actuation of the moving means.

According to a preferred embodiment, the moving means comprises a rotating actuator, preferably a stepper motor. According to another exemplary embodiment, the moving means comprises a bi-metal actuator.

In this way, motion of the moving means can be carried out in a precise manner.

According to an exemplary embodiment, the luminaire system may further comprise a controlling means. The controlling means may be configured for controlling the rotating actuator of the moving means and the driver and optionally the dimmer to control the movement, the intensity, the light colour, and the light colour temperature respectively. Preferably, the controlling means is configured to set a particular position of the second support relative to the first support in combination with a light intensity and/or flashing pattern and/or light colour and/or light colour temperature. In the context of the present application "light colour data" can refer to data for controlling a colour (e.g. the amount of red or green or blue) and/or data for controlling a type of white light (e.g. the amount of "cold" white or the amount of "warm" white). According to another exemplary embodiment the controlling means may be configured for controlling the moving means, driver, and optionally dimmer of more than one luminaire system.

According to an exemplary embodiment, the luminaire system may comprise a plurality of first light sources having a first colour and a plurality of second light sources having a second colour different from the first colour, said plurality of first and second light sources being arranged on one of the first support and the second support. The luminaire system may also comprise one or more optical elements arranged on the other one of the first and the second support and associated with the plurality of first and second light sources, said one or more optical elements configured for mixing light emitted from the plurality of first and second light sources.

For example, a light source among the plurality of first light sources and a light source among the plurality of second light sources may be arranged on the first support, under a common optical element among the one or more optical elements arranged on the second support. The controlling means may be configured to set a first particular position of the second support relative to the first support corresponding to a first overall colour temperature and a first light distribution from the common optical element, and to set a second particular position of the second support relative to the first support corresponding to a second overall colour temperature and a second light distribution from the common optical element. In this way, the variation of said relative position enables to vary the overall colour temperature pattern or distribution of light through the common optical element together with the light distribution of said light.

Additionally, the controlling means may independently control the light intensity of the plurality of first light sources according to a first control profile and the light intensity of the plurality of second light sources according to a second control profile, thereby increasing the flexibility in adjusting the overall colour temperature of light through the common optical element.

According to an exemplary embodiment, the luminaire system further comprises a sensing means. The sensing means may comprises any one or more of a presence sensor, an ambient light sensor, an ambient visibility sensor, a traffic sensor, a dust particle sensor, a sound sensor, an image sensor such as a camera, an astroclock, a temperature sensor, a humidity sensor, a ground condition measurement sensor such as a ground reflectivity sensor, a lighting pattern sensor, a speed detection sensor.

According to a preferred embodiment, the luminaire system further comprises a sensing means configured to acquire a measure for a position of the second support relative to the first support. The controlling means may be configured to control the moving means in function of the acquired measure.

In this manner, the sensing means can obtain the position of the second support relative to the first support and a specific desired light distribution corresponding to a specific position of the second support can be achieved by the movement of the second support with respect to the first support controlled by the controlling means.

According to an exemplary embodiment, the luminaire system further comprises an environment sensing means configured to detect environmental data. The controlling means may be configured to control the moving means in function of the detected environmental data. In another embodiment, the environment sensing means may be provided to another component of a luminaire, e.g. to a pole of the luminaire, or in a location near the luminaire.

In this way, the environment sensing means can detect environmental data, e.g. luminosity, visibility, weather condition, sound, dynamic object (presence and/or speed), ground condition such as a ground reflectivity property, humidity, temperature, lighting pattern, time of the day, day of the year, of the surroundings of the luminaire system. The environment sensing means may already be provided to the luminaire system or may be added in a later phase of the luminaire system installation. Controlling the moving means in function of the detected environmental data may allow changing the light distribution, and thus the lighting pattern of the luminaire system in accordance with the detected environmental data in a more dynamic manner, e.g. compensating luminosity depending on weather or time of the day, changing to a lighting pattern more adapted for a passing cyclist.

According to a preferred embodiment, the luminaire system further comprises a pattern sensing means, e.g. a camera, configured to acquire a measure for a lighting pattern produced by the luminaire system. The controlling means may be configured to control the moving means in function of the acquired measure. In another embodiment, the pattern sensing means may be provided to another component of a luminaire, e.g. to a pole of the luminaire, or in a location near the luminaire.

In this manner, the pattern sensing means can acquire a measure of a lighting pattern associated with a corresponding position of the plurality of optical elements. Then, controlling the moving means in function of the acquired measure will enable a more adapted lighting pattern to be achieved relative to the current environment of the luminaire system. Further, acquiring a measure of the surface area associated with the lighting pattern will enable the correlation between a position of the plurality of optical elements and the resulting lighting pattern.

In an embodiment with a feedback loop, the controlling means may correct, and more in particular may regularly or continuously correct the position of the plurality of optical elements respective to the plurality of light sources based on the sensed data, e.g. data from the pattern sensing means, data from the environment sensing means or data from a sensing means configured to acquire a measure for a position of the second support relative to the first support. It is noted that also data from any sensing means of nearby luminaire systems may be taken into account when correcting the position. Further, the data of the environment sensing means of one luminaire system may be used for controlling several nearby luminaire systems. For example, if a luminaire is positioned between two other luminaires, the lighting patterns thereof may partially overlap. The lighting pattern measured by the central luminaire may also be used to correct the position of the plurality of optical elements respective to the plurality of light sources of the other two luminaires.

The skilled person will understand that the hereinabove described technical considerations and advantages for luminaire system embodiments also apply to the below described corresponding luminaire systems network embodiments, mutatis mutandis.

According to a preferred embodiment, there is provided a luminaire systems network. The luminaire systems network comprises a plurality of luminaire systems preferably according to any one of the embodiments disclosed above, and a remote device. The plurality of luminaire systems may be comprised by one or more luminaire heads. The remote device is configured to send lighting data to each luminaire system. The controlling means of the or each luminaire system is further configured for controlling the moving means based on the lighting data received by the luminaire system. Lighting data may comprise e g dimming data, switching data, pattern data, movement data, light colour data, flashing pattern data, light colour temperature data, etc. For example, the movement data for a particular luminaire system may be determined by the remote device based on measurement data measured by one or more sensors associated with the luminaire heads or associated with another connected system. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

DESCRIPTION OF THE FIGURES

Figure 1A:
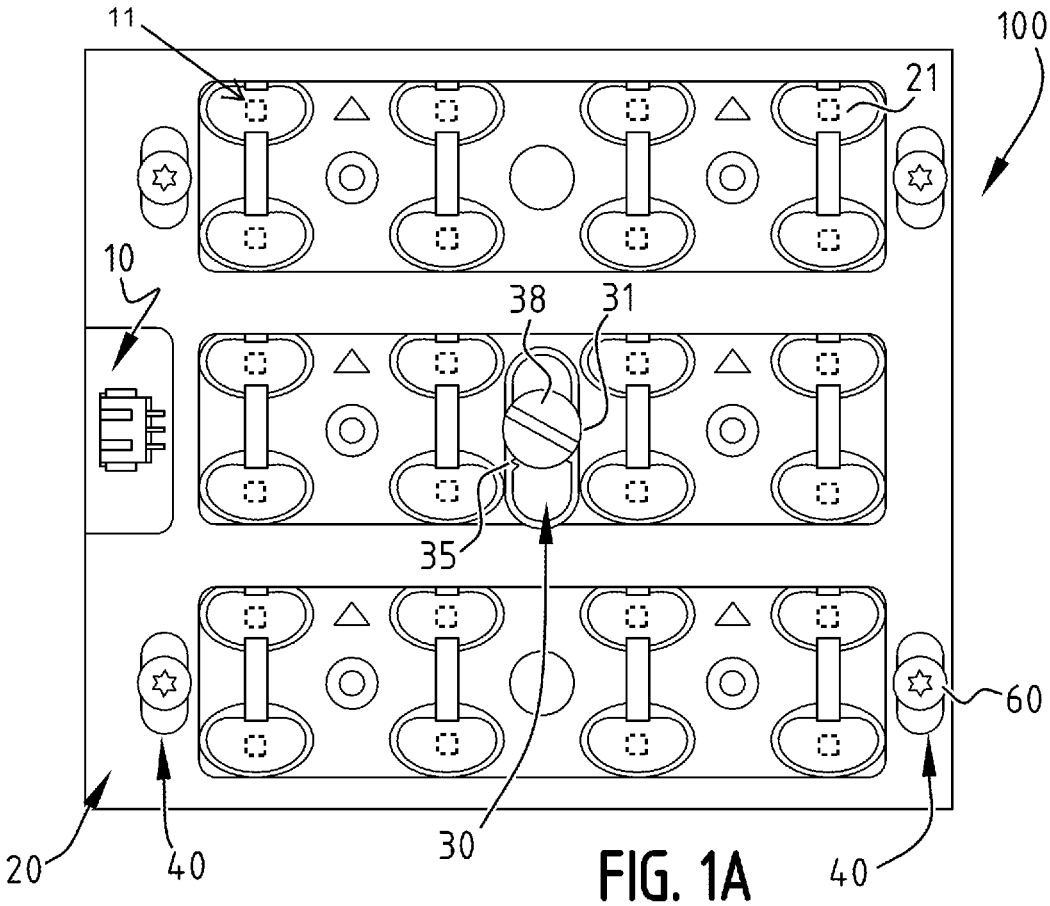
FIGS. 1A-1B show a top view of and a more detailed closer view, respectively, of an exemplary embodiment of a luminaire system.
Figure 1B:
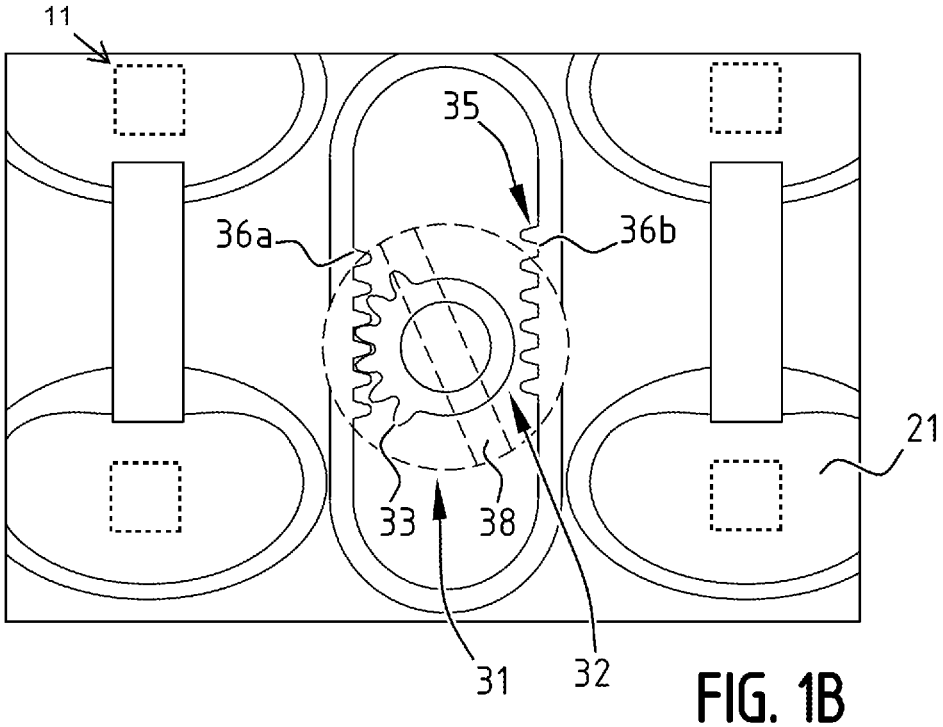

FIGS. 1A-1B show a top view and a more detailed closer view, respectively, of an exemplary embodiment of a luminaire system according to the present invention. The luminaire system of FIGS. 1A-1B may be included in a housing of a luminaire head. The luminaire head may be connected in any manner known to the skilled person to a luminaire pole. Typical examples of such systems are street lights. In other embodiments, the luminaire head may be connected to a wall or another surface, e.g. for illuminating buildings or tunnels.

As illustrated in FIGS. 1A-1B, the luminaire system 100 comprises a first support 10, a second support 20, and a moving means 30. The first support 10 is preferably fixed to a housing of the luminaire system, and comprises a first surface and a second surface opposite said first surface. A plurality of light sources 11 may be arranged on one of the first support 10 and the second support 20, and is configured to emit light through one or more optical elements associated with the plurality of light sources 11 and arranged on the other one of the first support 10 and second support 20.

In the exemplary embodiment of FIGS. 1A-1B, the first support 10 comprises the plurality of light sources 11 mounted on the first surface. The first support 10 may comprise a supporting substrate, e.g. a PCB, and a heat sink onto which the supporting substrate may be mounted. The housing may be arranged around the first support 10 and may comprise a planar surface onto which the first support 10 is provided. The plurality of light sources 11 may comprise a plurality of LEDs. Further, each light source 11 of the plurality of light sources may comprise a plurality of LEDs, more particularly a multi-chip of LEDs. In the embodiment of FIGS. 1A-1B, the plurality of light sources 11 corresponds to twenty-four light sources arranged in a two-dimensional array of six rows by four columns.

In other embodiments, the plurality of light sources 11 may be arranged without a determined pattern, or in an array with at least two rows of light sources and at least two columns of light sources. It should be clear for the skilled person that the number of rows and columns may vary from one embodiment to another. The LEDs may be disposed on the PCB and mounted on top of a planar surface of the heat sink made of a thermally conductive material, e.g. aluminium. The surface onto which the plurality of light sources 11 is mounted onto may be made reflective or white to improve the light emission. The plurality of light sources 11 could also be lights other than LEDs, e.g. halogen, incandescent, or fluorescent lamp.

In the exemplary embodiment of FIGS. 1A-1B, the second support 20 comprises one or more optical elements 21 associated with the plurality of light sources 11. The one or more optical elements 21 correspond to twenty-four optical elements 21 arranged in a two-dimensional array of six rows by four columns associated with the plurality or light sources 11. In other embodiments, the one or more optical elements 21 may be arranged without a determined pattern or in an array with at least two rows of optical elements 21 and at least two columns of optical elements 21. It should be clear for the skilled person that the number of rows and columns may vary from one embodiment to another. In other embodiments, some of the plurality of light sources 11 may not be associated with an optical element 21. In the embodiment of FIGS. 1A-1B, each optical element 21 of the twenty-four optical elements extends over one corresponding light source 11 of the twenty-four light sources, and the optical elements 21 are similar in size and shape. In another exemplary embodiment, at least one optical element 21 may not extend over a corresponding light source of the plurality of light sources 11. In another exemplary embodiment, some or all of the optical elements 21 may be different from each other. In a further exemplary embodiment, there are more optical elements 21 than light sources 11. In yet other embodiments there may be provided a plurality of LEDs below each or some of the optical elements 21.

In the exemplary embodiment of FIGS. 1A-1B, the second support 20 is movable with respect to the first support 10. It should be clear for the skilled person that in other exemplary embodiments the second support 20 may comprise a plurality of light sources 11 mounted on a first surface, and that the first support 10 may comprise one or more optical elements associated with the plurality of light sources 11. Hence the configuration of the first support 10 and of the second support 20 is interchangeable in the present invention.

The one or more optical elements 21 may be part of an integrally formed optical plate comprised in the second support 20, as illustrated in FIGS. 1A-1B. In other words, the one or more optical elements 21 may be interconnected so as to form an optical plate comprising the one or more optical elements 21. The optical plate may be formed, e.g. by injection moulding, casting, transfer moulding, or in another appropriate manner. Alternatively, the one or more optical elements 21 may be separately formed, e.g. by any one of the above mentioned techniques. The second support 20 may comprise a frame (not shown) and an optical plate integrating the one or more optical elements 21. The optical plate may be carried by the frame, or may be free-standing instead of being carried by the frame. The frame may be a rectangular plate with a first surface facing the plurality of light sources 11 and a second surface opposite the first surface.

The one or more optical elements 21 may comprise a plurality of lens elements associated with the plurality of light sources 11, as illustrated in FIGS. 1A-1B. At least one lens element of the plurality of lens elements may have a first surface and a second surface located on opposite sides thereof. The first surface is a convex surface and the second surface may be a concave surface, but may also be a planar surface, facing at least one light source of the plurality of light sources 11. Further, it should be clear for the skilled person that the one or more optical elements 21 may additionally or alternatively comprise other elements than lens elements, e.g. reflector, backlight element, prism, collimator, diffusor, and the like.

At least one lens element of the plurality of lens elements may be free form in the sense that it is not rotation symmetric. In the embodiment of FIGS. 1A-1B, the lens elements have a symmetry axis along an internal dimension D of the lens elements. In another embodiment, the lens element may have no symmetry plane/axis at all. The internal dimension D is defined as the dimension of the lens element on a side facing the plurality of light sources 11 along a movement direction of the second support 20, as described in a later paragraph. The plurality of lens elements may have a maximum length different from a maximum width. Said length is defined as an internal dimension on a side facing the plurality of light sources 11 as seen in the movement direction of the second support 20, and said width is defined as an internal dimension on a side facing the plurality of light sources 11 as seen perpendicularly to the movement direction of the second support 20. The lens elements are in a transparent or translucent material. They may be in optical grade silicone, glass, poly(methyl methacrylate) (PMMA), polycarbonate (PC), or polyethylene terephthalate (PET).

The light distribution adaptability of the luminaire system 100 is made easier by the common movement of the plurality of light sources 11 or of the one or more optical elements 21 rather than on an individual basis. At the same time, exemplary embodiments of the invention reduce the number of parts to be kept in stock for maintenance. In other embodiments, changing the position of the plurality of light sources 11 or of the one or more optical elements 21 may be done to compensate for mounting or apparatus inaccuracies.

The movement of the plurality of light sources 11 or of the one or more optical elements 21 is achieved thanks to the moving means 30. FIG. 1B illustrates more in detail exemplary embodiments of different parts of the moving means 30. The moving means 30 comprises a rotatable element 31 provided to one of the first support 10 or the second support 20. In FIGS. 1A-1B, the rotatable element 31 is configured for rotating around a rotation axis perpendicular to the first support 10. The rotation axis of the rotatable element 31 may be fixed with respect to the first support 10. To achieve that, the rotatable element 31 may be fixed to the first support 10 or to any other portion of the luminaire system 100 fixed with respect to the first support 10. The second support 20 may be configured to move in contact with the upper surface of the first support 10. In other exemplary embodiments, the rotation axis of the rotatable element 31 may be fixed with respect to the second support 20 instead of the first support 10.

In still another exemplary embodiment, the second support 20 is mounted at a distance from the first support 10, e.g. a PCB. To that end, the first support 10 may be provided with distance elements on which the second support 20 is movably supported. Optionally, a surface of the second support 20 facing the first support 10 may be provided with tracks or guides cooperating with the distance elements. Such tracks or guides may be formed integrally with the rest of the second support 10. Optionally, the distance elements may be adjustable in order to adjust the distance between the first support 10 and the second support 10. For example, the distance elements may comprise a screw thread cooperating with a bore arranged in/on the first support 10.

The rotatable element 31 comprises a first conversion portion 32. The first conversion portion 32 cooperates with a second conversion portion 35. Since the first conversion portion 32 is provided to the rotatable element 31 whose rotation axis is fixed with respect to the first support 10 in FIGS. 1A-1B, the second conversion portion 35 is provided to the second support 20. The cooperation of the first and second conversion portion 32, 35 ensures the conversion of a rotational movement of the rotatable element 31 into a movement of the second support 20 with respect to the first support 10. Depending on the design of the first and second conversion portions 32, 35, the skilled person will understand that various movements, e.g. translation, rotation, curved trajectory, trajectory with acute angles, of the second support 20 with respect to the first support 10 may be implemented by converting a rotational movement.

The first conversion portion 32 of FIG. 1B comprises a circular gear element portion 33 whose rotation axis is similar to the rotation axis of the rotatable element 31. The circular gear element portion 33 may be provided with a plurality of inter-engaging teeth on a fraction of the circumference of the circular gear element portion 33 or on its full circumference, a fraction in FIG. 1B. The second conversion portion 35 may comprise another plurality of inter-engaging teeth configured for cooperating with the plurality of inter-engaging teeth of the circular gear element portion 33. The second conversion portion 35 may be shaped according to the desired type of movement of the second support 20 with respect to the first support 10.

In a non-illustrated exemplary embodiment, the rotatable element 31 may comprise a plunger and ratchet mechanism. The second conversion portion 35 may comprise teeth cooperating with the plunger and ratchet mechanism. Providing an impulse to the plunger, whose position is restored via a spring, induces a rotation of the ratchet. The rotation of the ratchet will cause a movement of the second support 20 with respect to the first support 10 due to the cooperation between the ratchet and the second conversion portion 35.

The second conversion portion 35 of FIGS. 1A-1B extends along a substantially straight trajectory in the plane of the second support 20 perpendicularly to the rotation axis of the circular gear element portion 33. Since the second conversion portion 35 comprises a linear gear element portion 36*a*, 36*b*, the movement of the second support 20 with respect to the first support 10 will be a translational movement. In FIGS. 1A-1B, the plurality of lens elements 21 are freeform and have a varying profile along the translational movement direction of the second support 20 with respect to the first support 10, and thus the light distribution of the luminaire system will be altered as the second support 20 is translated thanks to the moving means 30. By light distribution, it is meant the light envelope in space, formed by the light emitted by the plurality of light sources 11 through the one or more optical elements, and which represents the emission directions and the intensity variations of the light through the one or more optical elements.

In the exemplary embodiment of FIGS. 1A-1B, the rotatable element 31 is provided substantially in the centre of the first support 10. The second conversion portion 35 provided to the second support 20 may be an integral part of the second support 20 and comprises an opening allowing access to the first support 10. The rotatable element 31 may extend through the second support 20 via the opening. In an alternative embodiment, the rotatable element 31 and the second conversion portion 35 may be provided to a lateral side of the first and second supports 10, 20.

The partial circular gear element portion 33 of FIG. 1B is configured for cooperating with two linear gear element portions 36*a*, 36*b* located on either side of the partial circular gear element portion 33 and comprises the plurality of inter-engaging teeth on less than 50% of the circumference of the partial circular gear element portion 33. Rotating the rotatable element 31 will cause the partial circular gear element portion 33 to cooperate with the first linear gear element portion 36*a* such that the second support 20 is translated along a first direction with respect to the first support 10. Continuing the rotation of the rotatable element 31 in the same direction will cause the partial circular gear element portion 33 to cease cooperation with the first linear gear element portion 36*a*, and to cooperate with the second linear gear element portion 36*b* such that the second support 20 is translated along a second direction opposite the first direction with respect to the first support 10. In another exemplary embodiment, the circular gear element portion 32 comprises inter-engaging teeth around its full circumference cooperating with the two linear gear element portions 36*a*, 36*b* and the direction of the second support 20 movement is changed by changing the rotation direction of the rotatable element 31.

In another exemplary embodiment, there may be a first and a second moving means comprising conversion portions, said first moving means being configured to move the second support 20 relative to the first support 10 along a first direction in the movement plane substantially parallel to the first support 10, and said second moving being configured to move, independently from the first moving means, the second support 20 relative to the first support 10 along a second direction in the movement plane substantially parallel to the first support 10.

In yet another exemplary embodiment, in addition to the moving means, the luminaire system may comprise an elevating means configured to change the elevation of the second support 20 relative to the first support 10 such that the distance between the first and second supports 10, 20 is changed. The change in elevation may be carried in discrete steps or in a continuous manner.

To further stabilize the movement of the second support 20 with respect to the first support 10, the luminaire system 100 may further comprise a guiding means 40. In the exemplary embodiment of FIG. 1A, the guiding means 40 comprises a plurality of elongated guiding holes located in the second support 20 and extending in a direction similar to the movement direction of the second support 20 with respect to the first support 10. In another exemplary embodiment, the guiding means 40 may comprise a first sliding guide and a second sliding guide at opposite side edges of the first or second support 10, 20, and optionally may be integrally formed with the first or second support 10, 20. In yet another exemplary embodiment, the movement of the second support 20 with respect to the first support 10 may include a displacement being simultaneously or alternately along two perpendicular axes of the movement plane and the guiding means may comprise a plurality of guiding members configured for guiding the second support 20 with respect to the first support 10 along the two perpendicular axes.

FIG. 1A illustrates four elongated guiding holes located each substantially at a corner of the second support 20. Fixation means 60 are extending through the plurality of elongated guiding holes such that the second support 20 is kept in contact with or at a predetermined distance, optionally adjustable, from the first support 10 while preventing the second support 20 from moving in a direction perpendicular to the main direction of the plurality of elongated guiding holes. The finite dimensions of the plurality of elongated guiding holes along their main directions may form a stopping means to prevent the movement of the second support 20 with respect to the first support past a predetermined point. The skilled person will understand that such stopping means may be implemented in a wide variety of ways.

The moving means 30 may further comprises an actuation element 38. The actuation element 38 allows an operator to rotate the rotatable element 31 of the moving means 30. In FIG. 1A, the top of the rotatable element is shaped such that it can be actuated by a flathead screwdriver. In other exemplary embodiments, the actuation element may be a knob, a lever, or comprise a ferromagnetic material or a magnet. In still another exemplary embodiment, the moving means 40 may comprise a rotating actuator, preferably a stepper motor, to activate the rotatable element. According to another exemplary embodiment, the moving means comprises a bi-metal actuator configured for rotating the rotatable element 31, for example via a ratchet element. The luminaire system 100 may further comprise one or more positioning elements such that the one or more positioning elements corresponds to a plurality of lighting patterns on a surface to be illuminated by the luminaire system 100. The one or more positioning elements may be provided in or on the first or second support 10, 20, or may be provided to another part of the luminaire system 100 fixed with respect to the first or second support 10, 20. To provide additional controllable parameters to induce variations in the lighting patterns, the luminaire system 100 may comprise a driver configured for driving the plurality of light sources 11, and optionally a dimmer configured to control the driver to drive one or more of the plurality of light sources 11 at a dimmed intensity and/or at a desired light colour and/or at a desired light colour temperature.

According to a non-illustrated exemplary embodiment, the luminaire system 100 may further comprise a controlling means. The controlling means may be configured for controlling the rotating actuator of the moving means 30 and the driver and optionally the dimmer to control, e.g. the movement, and/or the intensity, and/or the flashing pattern, and/or the light colour and/or the light colour temperature. Preferably, the controlling means is configured to set a particular position of the second support 20 relative to the first support 10 in combination with a light intensity and/or light colour. In the context of the present application "light colour data" can refer to data for controlling a colour (e.g. the amount of red or green or blue) and/or data for controlling a type of white light (e.g. the amount of "cold" white or the amount of "warm" white). According to another exemplary embodiment the controlling means may be configured for controlling the moving means 30, driver, and optionally dimmer of more than one luminaire system 100.

According to yet another preferred embodiment there is provided a luminaire systems network. The luminaire systems network comprises a plurality of luminaire systems 100 and a remote device. The plurality of luminaire systems 100 may be comprised by one or more luminaire heads. The remote device is configured to send lighting data to each luminaire system 100. The controlling means of each luminaire system 100 is further configured for controlling the moving means 30 based on the lighting data received by the luminaire system 100. Lighting data may comprise e.g. dimming data, switching data, pattern data, movement data, light colour data, etc. For example, the movement data for a particular luminaire system 100 may be determined by the remote device based on measurement data measured by one or more sensors associated with the luminaire heads. It is further possible to link the movement data to the light colour data or to the dimming data, so that the light colour is changed during the moving or after the moving, and/or such that the light intensity is changed during the moving or after the moving.

Figure 1C:
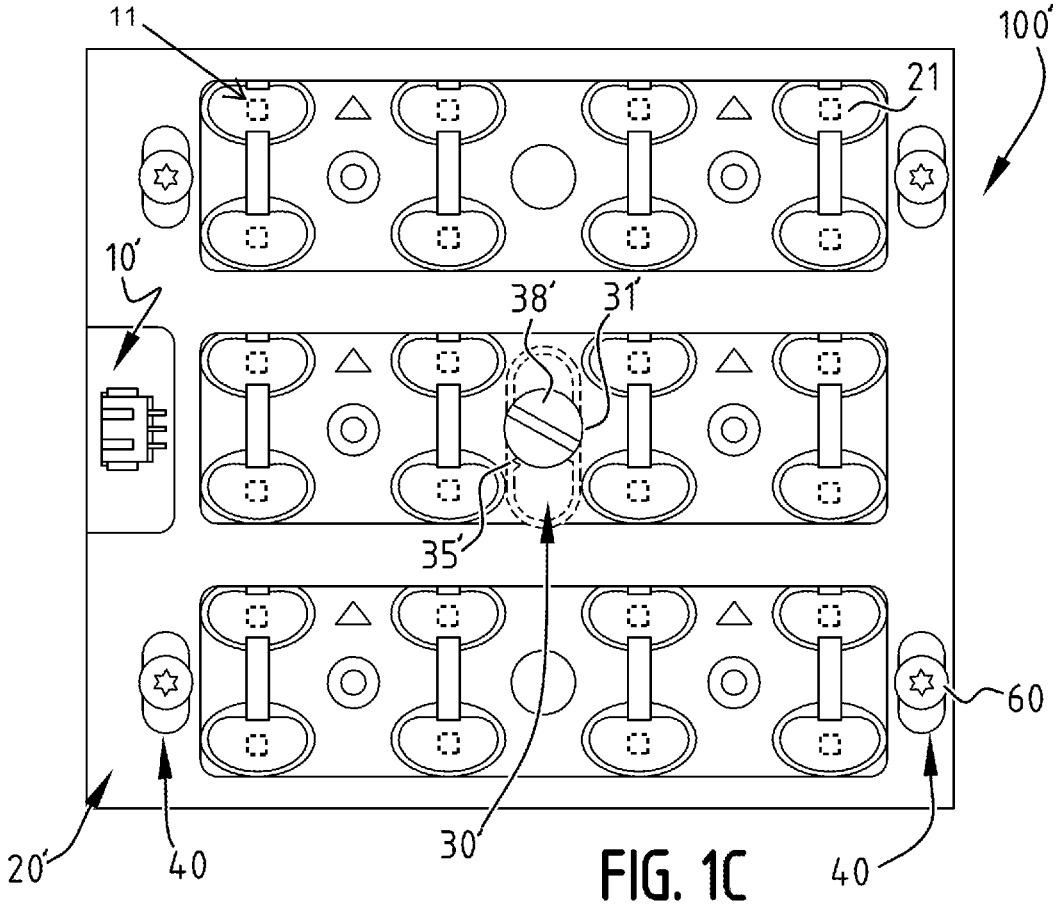
FIGS. 1C-1D show a top view of and a more detailed closer view, respectively, of an additional exemplary embodiment of a luminaire system.
Figure 1D:
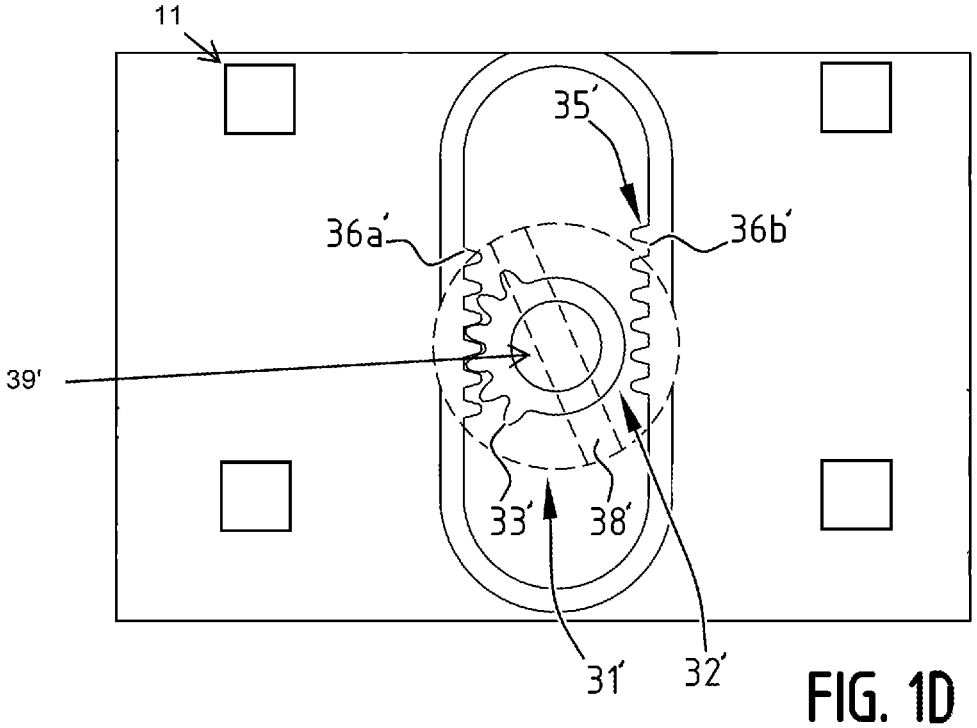

FIGS. 1C-1D show a top view of and a more detailed closer view, respectively, of an additional exemplary embodiment of a luminaire system according to the present invention. As illustrated in FIGS. 1C-1D, the luminaire system 100' comprises a first support 10' with a plurality of light sources 11, a second support 20' comprising one or more optical elements 21 associated with the plurality of light sources 11, and a moving means 30'. FIGS. 1C-1D have similar features with FIGS. 1A-1B, respectively, apart from the following.

The movement of the one or more optical elements 21 with respect to the plurality of light sources 11 is achieved thanks to the moving means 30'. FIG. 1D illustrates more in detail exemplary embodiments of different parts of the moving means 30'. In the embodiments of FIGS. 1C-1D, the moving means 30' comprises a rotatable element 31' provided to the second support 20'. In FIGS. 1C-1D, the rotatable element 31' is configured for rotating around a rotation axis perpendicular to the second support 20'. The rotation axis of the rotatable element 31' may be fixed with respect to the second support 20'. To achieve that, the rotatable element 31' may be fixed to the second support 20'. In FIG. 1D, a circular cross-section of a rotation axle 39' of the rotatable element 31' is visible, said rotation axle 39' extending through a through-hole in the second support 20'.

The rotatable element 31' comprises a first conversion portion 32'. The first conversion portion 32' cooperates with a second conversion portion 35'. Since the first conversion portion 32' is provided to the rotatable element 31', at an extremity of the rotation axle 39', and whose rotation axis is fixed with respect to the second support 20' in FIGS. 1C-1D, the second conversion portion 35' is provided to the first support 20'. The cooperation of the first and second conversion portion 32', 35' ensures the conversion of a rotational movement of the rotatable element 31' into a movement of the second support 20 with respect to the first support 10'.

In the exemplary embodiment of FIGS. 1C-1D, the rotatable element 31' is provided substantially in the centre of the second support 20'. The second conversion portion 35' provided to the first support 10' may be an integral part of the first support 10' and comprises an opening configured for the first conversion portion 32' to be arranged within.

The moving means 30' may further comprises an actuation element 38', at another extremity of the rotation axle 39'. The actuation element 38' allows an operator to rotate the rotatable element 31' of the moving means 30'. In FIG. 1C, the top of the rotatable element 31' is shaped such that it can be actuated by a flathead screwdriver.

A partial circular gear element portion 33' comprised by the first conversion portion 32', as illustrated in FIG. 1D, is configured for cooperating with two linear gear element portions **36*a*', 36*b*' comprised by the second conversion portion 35' located on either side of the partial circular gear element portion 33'. Each of the two linear gear element portions 36*a*', 36*b*' comprises a plurality of inter-engaging teeth on less than 50% of the circumference of the partial circular gear element portion 33'. Rotating the rotatable element 31' will cause the partial circular gear element portion 33' to cooperate with the first linear gear element portion 36*a*' such that the second support 20' is translated along a first direction with respect to the first support 10'. Continuing the rotation of the rotatable element 31' in the same direction will cause the partial circular gear element portion 33' to cease cooperation with the first linear gear element portion 36*a*', and to cooperate with the second linear gear element portion 36*b*' such that the second support 20' is translated along a second direction opposite the first direction with respect to the first support 10'**.

Figure 2A:
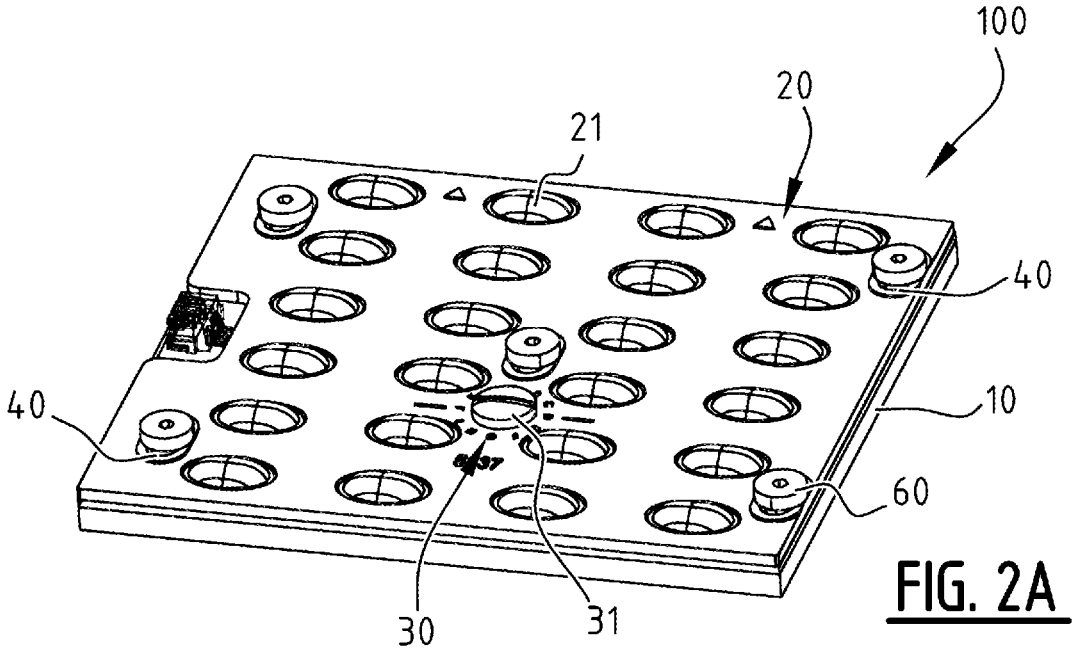
FIGS. 2A-2C illustrate perspective views of an exemplary embodiment of a luminaire system and of a moving means of a luminaire system.
Figure 2B:
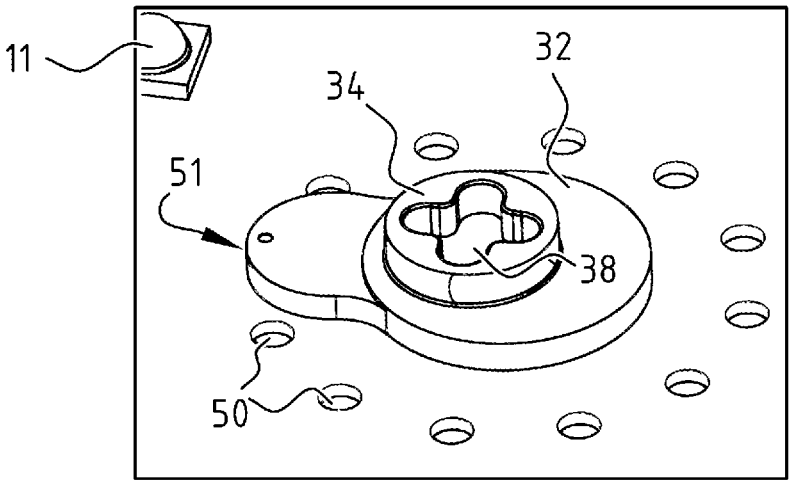
Figure 2C:
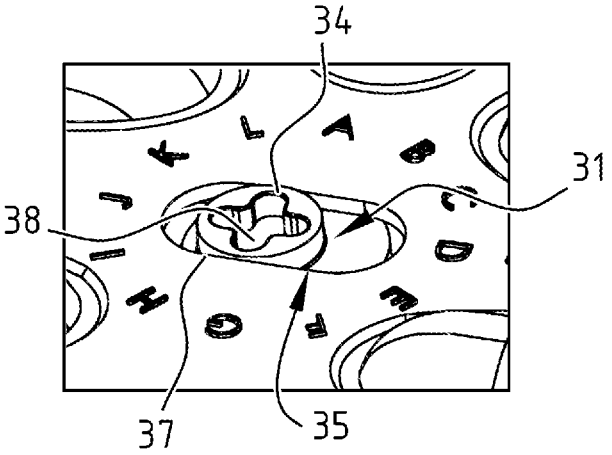

FIGS. 2A-2C illustrate perspective views of an exemplary embodiment of a luminaire system and of moving means of a luminaire system according to the present invention. The luminaire system 100 comprises a first support 10, a second support 20, and a moving means 30. As illustrated in FIG. 2A, the first support 10 may comprise twenty fours light sources, preferably LEDs, organized in six rows and four columns. The second support 20 may comprise a plurality of optical elements 21, each one of the plurality of optical elements 21 being placed over one of the plurality of light sources.

In the exemplary embodiment of FIG. 2A, the second support is kept in contact with the first support using a plurality of fixation means 60. The plurality of fixation means 60 extends through a plurality of elongated guiding holes located in the second support 20. There are five elongated guiding holes in FIG. 2A, four elongated guiding holes each located substantially at a corner of the rectangular-shaped second support 20, and one elongated guiding hole located substantially at the centre of the second support 20. The plurality of elongated guiding holes extends in a direction of movement of the second support 20 with respect to the first support 10.

FIGS. 2B-2C illustrate exemplary embodiments of the moving means 30 in more details. The moving means 30 comprises a rotatable element 31. The rotatable element 31 is fixed to the first support 10 in FIG. 2A-2C and is configured to rotate around a rotation axis perpendicular to the movement plane of the second support 20 with respect to the first support 10. The moving means 30 may further comprise an actuation element 38. The actuation element 38 allows an operator to rotate the rotatable element 31 of the moving means 30. In FIGS. 2B-2C, an upper element of the rotatable element 31 is shaped such that it can be actuated by a flathead screwdriver and is configured to couple with the actuation element 38 designed with a cross-shaped indent, said cross-shaped indent configured for cooperating with a corresponding cross-shaped protrusion (not shown) of the upper element. As illustrated in FIG. 2B, the rotatable element 31 comprises a first conversion portion 32 that may comprises a cylindrical element centred around the rotation axis of the rotatable element 31. Another cylindrical element is provided on top of the centred cylindrical element. The other cylindrical element is centred off-axis with respect to the rotation axis of the rotatable element 31 and forms an eccentric element 34.

The eccentric element 34 may be placed in a plurality of predetermined positions thanks to one or more positioning elements 50. In the exemplary embodiments of FIG. 2B, the one or more positioning elements 50 comprises a plurality of depressions in the surface of the first support 10, said plurality of depressions located at regular intervals and forming a circle centred around the rotation axis of the rotatable element 31. A protrusion extending outwardly from the rotatable element 31 is provided with a protuberance 51 facing the surface of the first support 10 such that it can cooperate with the one or more positioning elements 50 to position the eccentric element 34 in the plurality of predetermined positions. Additionally, marks may be associated to the one or more positioning elements 50 as a visual aid to the operator to determine the position of the moving means. Examples of marks may be letters, numbers, symbols, a scale. The marks may be provided to the actuator and/or the moving means and/or on the first and/or on the second support. In FIGS. 2A and 2C, the plurality of predetermined positions corresponds with a plurality of letters marked up on the upper surface of the second support 20.

Alternatively, the one or more positioning elements 50 may comprise one or more protuberances cooperating with at least one corresponding depression or protuberance. In yet another exemplary embodiment, the one or more positioning elements 50 may comprise a continuous ramp element, a spiral-shaped element centred around the rotation axis of the rotatable element, a linear or circular channel, and the like. In still yet another exemplary embodiment, the one or more positioning elements 50 may comprise one or more magnet elements and/or ferromagnetic materials such as to electromagnetically retain the moving means in the plurality of predetermined positions. The one or more magnet elements and/or ferromagnetic materials may be configured to cooperate with a corresponding positioning member of the rotatable element 31 comprising a magnet element and/or a ferromagnetic material.

A second conversion portion 35 may be provided to the second support 20. In FIG. 2C, the second conversion portion 35 comprises a guiding element 37, and may be integral to the second support 20. The guiding element 37 of FIG. 2A-2C is an elongated hole in the second support 20 extending in a direction perpendicular to the elongated guiding holes serving as guiding means 30. The eccentric element 34 extends through the guiding element 37 when the second support 20 is mounted on the first support 10. Rotating the rotatable element 31 from a first position to a second position of the plurality of predetermined positions will cause the translation of the second support 20 with respect to the first support 10 along the main direction of the elongated guiding holes, and the translation of the eccentric element 34 along the main direction of the guiding element 37. Indeed, since the guiding element 37 and the plurality of elongated guiding holes extend in perpendicular direction, the rotational movement of the eccentric element with respect to the rotation axis of the rotatable element 31 is decomposed in two translational movements: a translational movement of the eccentric element 34 with respect to the second support 20, a translational movement of the second support 20 with respect to the first support 10.

As illustrated in FIG. 2A, the plurality of optical elements 21 may be a plurality of lens elements. The plurality of lens elements may be freeform and have varying optical properties along a direction similar to the movement direction of the second support 20 with respect to the first support 10. The one or more positioning elements 50 is configured such that the plurality of predetermined positions corresponds with a plurality of lighting patterns on a surface to be illuminated by the luminaire system 100.

Figure 3A:
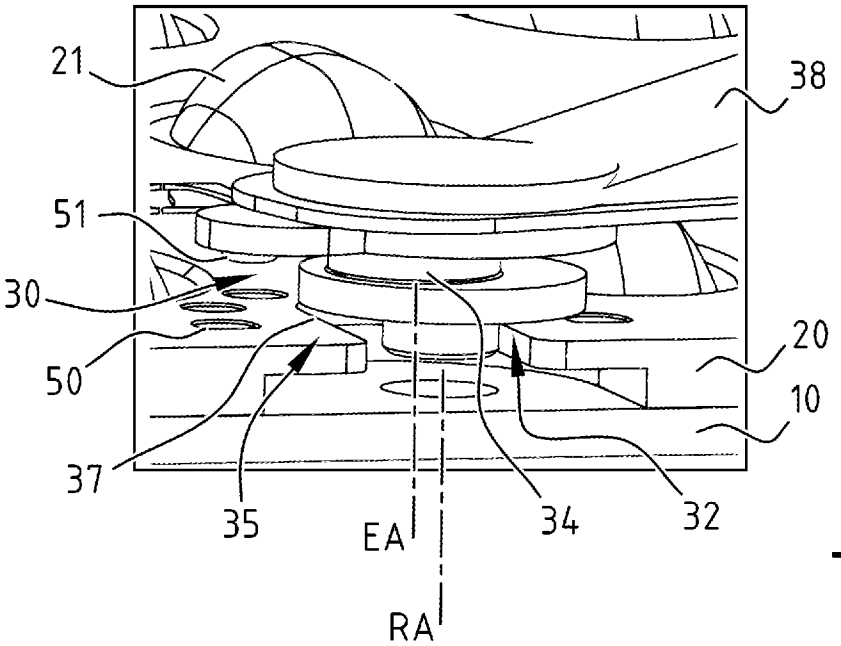
FIGS. 3A-3B show a perspective view of a further exemplary embodiment of a moving means of a luminaire system and a side view of a further exemplary embodiment of a luminaire system.
Figure 3B:
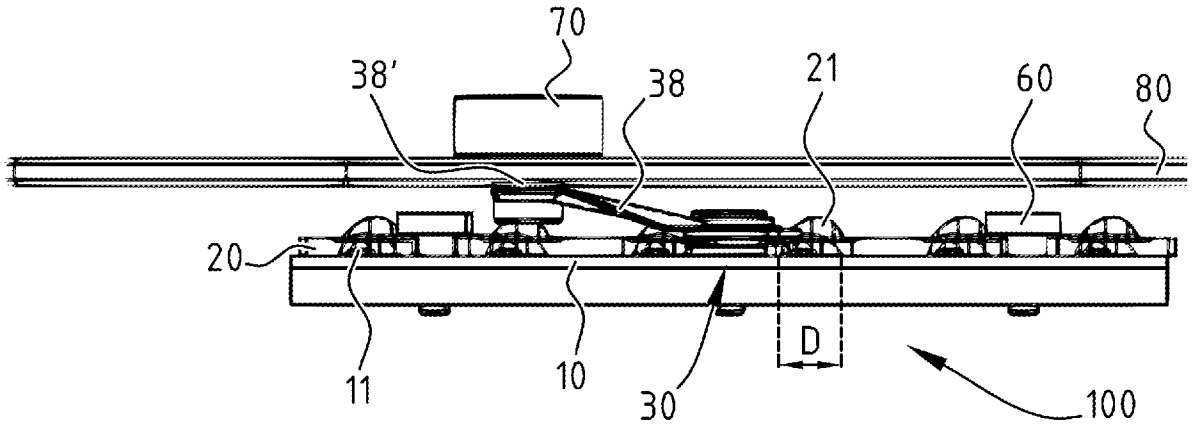

FIGS. 3A-3B show a perspective view of a further exemplary embodiment of a moving means of a luminaire system and a side view of a further exemplary embodiment of a luminaire system according to the present invention. The luminaire system 100 comprises a first support 10, a second support 20, and a moving means 30.

The moving means 30 comprises a rotatable element 31. As illustrated in FIGS. 3A-3B, the rotatable element 31 is fixed to the first support 10 and is located substantially at a lateral side of the first and second support 20. The conversion mechanism is similar to the one described in FIGS. 2A-2C in that the first conversion portion 32 comprises an eccentric element 34 cooperating with a guiding element 37 comprised by the second conversion portion 35.

The first conversion portion 32 in FIGS. 3A-3B comprises a cylindrical element centred around the rotation axis RA of the rotatable element 31. Another cylindrical element placed off-centred and on top of the centred cylindrical element forms the eccentric element 34. The eccentric element 34 is centred around an eccentric axis EA.

The second support 20 is provided with an undercut in order to accommodate the centred cylindrical element of the rotatable element 31. An opening extends through the second support 20 and connects to the undercut. The opening extends in a direction perpendicular to the lateral side of the second support 20 and forms the guiding element 37. When mounted, the eccentric element 34 extends through the guiding element 37. The lateral dimension of the guiding element 37 perpendicular to the main direction has a similar dimension as the diameter of the eccentric element 34. The guiding element 37 has an open side on the lateral side of the second support 20.

The second support 20 further comprises one or more positioning elements 50, a plurality of depressions located in the upper surface of the second support in the embodiment of FIGS. 3A-3B. Since the guiding element 37 is open on the lateral side of the second support 20, the plurality of depressions is placed at regular intervals along a semi-circle centred around the rotation axis RA. The rotatable element 31 comprises a protrusion extending outwardly with respect to the rotation axis RA. The protrusion is provided with a downward facing protuberance 51, said protuberance 51 configured for cooperating with the plurality of depressions.

Figure 4A:
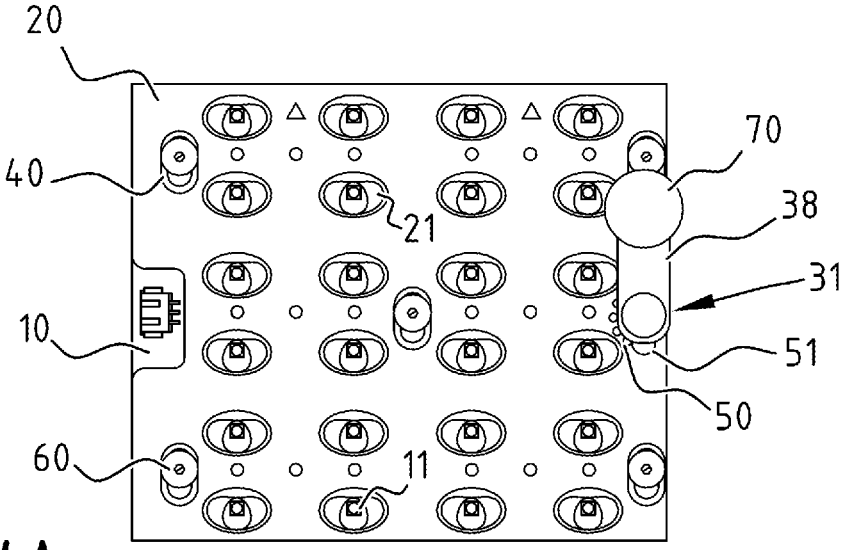
FIGS. 4A-4C illustrate top views of exemplary embodiments of a luminaire system.
Figure 4B:
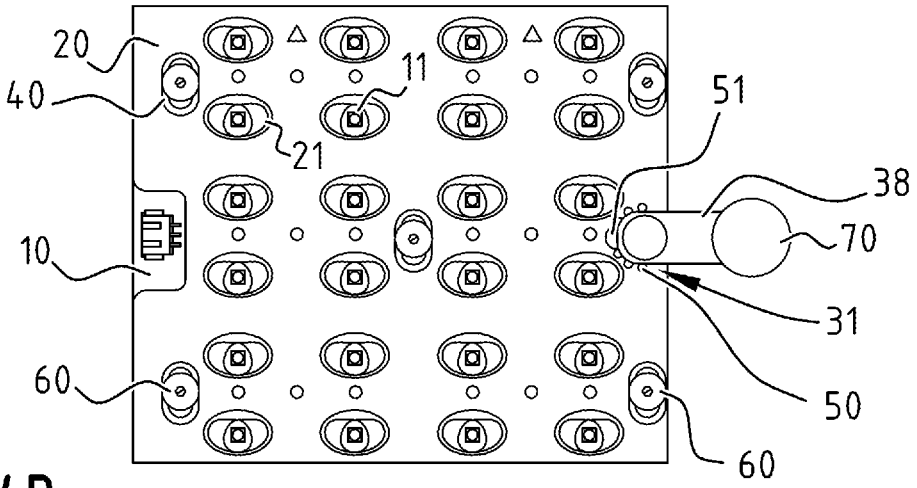
Figure 4C:
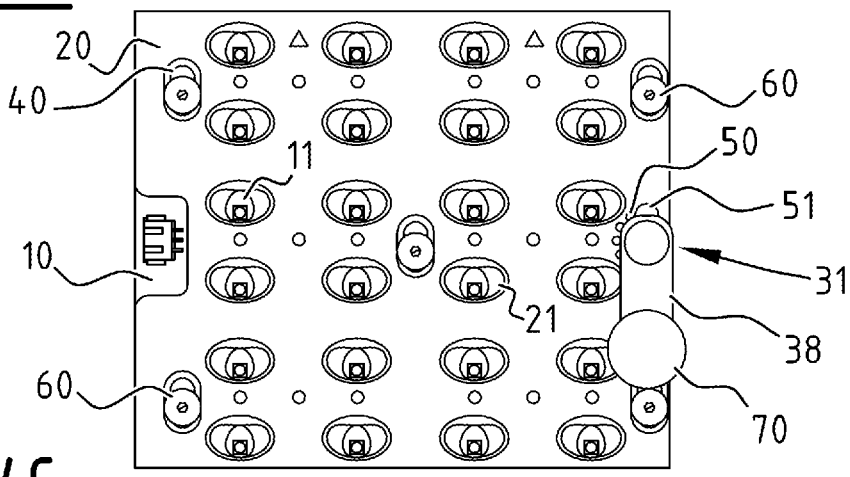

The rotatable element 31 may further comprise an actuation element 38, a lever in the embodiment of FIGS. 3A-3B. By rotating the lever, an operator can rotate the rotatable element 31, thereby inducing a translation of the second support 20 with respect to the first support 10. As will be described in a later paragraph, FIGS. 4A-4C illustrates three different predetermined positions of the second support 20 with respect to the first support 10 according to similar embodiments as the exemplary embodiments of FIGS. 3A-3B. Rotating the actuation element 38 will cause the translation of the second support 20 with respect to the first support in a direction substantially perpendicular to the main direction of the guiding element 37 such that the plurality of lens elements 21 is translated along its symmetry axis.

The actuation element 38 may comprise a ferromagnetic material 38'. In the exemplary embodiment of FIG. 3B, the luminaire system 100 comprises a housing 80 and the actuation element 38 extends upwardly to an inner surface of the housing 80. A portion of the actuation element 38 in close proximity with the inner surface of the housing 80 is provided with the ferromagnetic material 38'. Placing a magnet 70 in close proximity with an outer surface of the housing above the position of the ferromagnetic material 38' allows remote electromagnetic coupling of the ferromagnetic material 38' with the magnet 70. Displacing the magnet 80 while keeping the electromagnetic coupling enables to actuate the rotatable element 31 without opening the luminaire system housing 80. Alternatively, the actuation element 38 may comprise a magnet configured to be coupled with a ferromagnetic material located outside the luminaire system housing 80. Alternatively, the luminaire system 100 may comprise a compartment inside the housing 80 and the actuation element 38 extends instead to an inner surface of the compartment. In still another exemplary embodiment the moving means comprises a rotating actuator located inside the housing 80, preferably a stepper motor.

The lens element 21 of the plurality of lens elements as illustrated in FIG. 3B has a first surface and a second surface located on opposite sides. The first surface is a convex surface and the second surface is a concave surface facing a light source 11 of the plurality of light sources. The lens element 21 of the plurality of lens elements has an internal dimension D seen in the movement direction of the moving means, and the moving means 30 is configured to move the second support 20 with respect to the first support over a distance below 90% of the internal dimension D, preferably below 50% of the internal dimension D.

FIGS. 4A-4C illustrate top views of exemplary embodiments of a luminaire system according to the present invention. More particularly, FIGS. 4A-4C illustrate similar embodiments of the luminaire system 100 as described previously with respect to FIGS. 3A-3B.

The second support 20 may comprise one or more positioning elements 50, seven depressions in the top surface of the second support 20 in FIGS. 4A-4C. The seven depressions are placed at regular intervals around the rotation axis of the rotatable element 31 and describe a semi-circle. Rotating the lever 38 thanks to the magnet 70 allows changing the position of the second support 20 with respect to the first support via a translation along the main direction of the guiding means 40 as implemented by the elongated guiding holes 40 and the fixation means 60. FIG. 4A illustrates the first position of the plurality of predetermined positions. FIG. 4B illustrates the fourth position of the plurality of predetermined positions. FIG. 4C illustrates the seventh position of the plurality of predetermined positions.

In FIGS. 4A-4C, the plurality of lens elements 21 is similar and the lens elements 21 placed according to an array of six rows by four columns. The translation of the second support 20 with respect to the first support 10 is achieved in the column direction. The plurality of lens elements 21 has an internal dimension D as seen in the column direction. In an alternative embodiment, another plurality of optical elements may be provided to the plurality of light sources 11.

As illustrated in FIG. 4A, in the first position of the plurality of determined position, the plurality of light sources 11 may be located at one end of the internal dimension D. This position of the plurality of light sources 11 with respect to the overlying plurality of lens elements 21 will result in a first lighting pattern on the surface to be illuminated by the luminaire system 100.

As illustrated in FIG. 4B, displacing the magnet 70 in a clockwise rotational motion may allow actuating the electromagnetically-coupled actuation element 38 such that the protuberance 51 of the rotatable element 31 is moved to another depression 50 in the top surface of the second support 20. It is moved from the first to the fourth depression 50 in FIG. 4B. In the fourth position, the plurality of light sources 11 is located substantially in the middle of the internal dimension D and the plurality of fixation means 60 is located substantially in the middle of the plurality of elongated guiding holes 40 as seen in the movement direction. This position of the plurality of light sources 11 with respect to the overlying plurality of lens elements 21 will result in a different lighting pattern on the surface to be illuminated by the luminaire system 100.

As illustrated in FIG. 4C, the protuberance 51 of the rotatable element 31 is moved from the fourth to the seventh depression 50 by a clockwise rotational motion of the magnet 70. In the seventh position, the plurality of light sources 11 may be located at the other end of the internal dimension D. This position of the plurality of light sources 11 with respect to the overlying plurality of lens elements 21 will result in still another different lighting pattern on the surface to be illuminated by the luminaire system 100.

It is to be noted that the design of the first and second conversion portions 32, 35 will define the maximum travelling distance of the second support 20 with respect to the first support 10. In FIGS. 4A-4C, it has been designed such that the maximum travelling distance is less than the internal dimension D. In another exemplary embodiment, there may be more optical elements 21 than light sources 11, for example a first set and a second set of optical elements. The first and second conversion portions 32, 35 may be designed such that the light sources 11 are moved from the first set of overlying optical elements 21 to the second set of overlying optical elements 21.

Due to the lateral positioning of the rotatable element 31 with respect to the first and second supports 10, 20, the actuation element 38 is designed to be extending away from the first and second supports 10, 20 when actuated, not to occult light emitted from the plurality of light sources 11. Rotating the actuation element 38 clockwise or anticlockwise will allow freely changing from one position of the plurality of predetermined positions to another position. A spring element may be comprised in the moving means 30 to increase the force necessary to change the rotatable element 31 from the one position to the another position of the plurality of predetermined positions. Rotating the actuation element 38 past the range delimited within the first to seventh positions in FIGS. 4A-4C will not cause an additional movement of the second support 20 with respect to the first support 10 due to the open end of the guiding element 37 on said lateral side. Additionally, to prevent the second support 20 from moving past a predetermined point with respect to the first support 10, the end portions of the plurality of elongated guiding holes 40 form stopping means.

Figure 5:
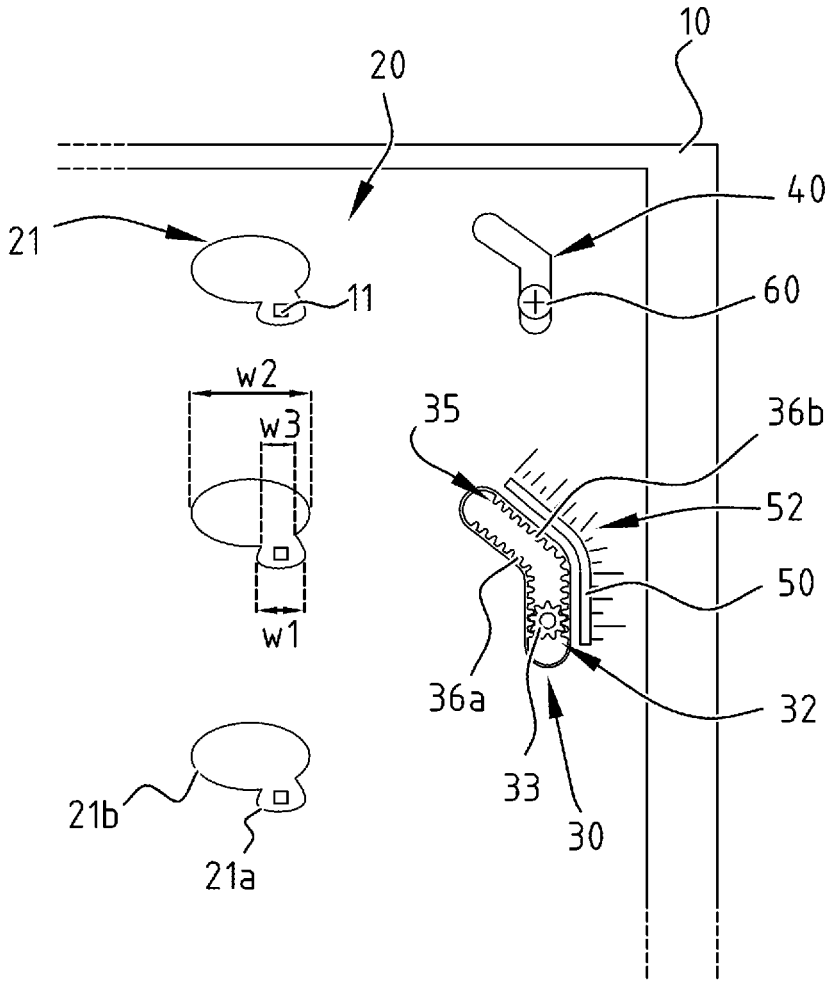
FIG. 5 illustrates a top view of another exemplary embodiment of a luminaire system.

FIG. 5 illustrate a top view of another exemplary embodiment of a luminaire system according to the present invention. The luminaire system 100 comprises a first support 10, a second support 20, and a moving means 30.

The moving means 30 may comprises a rotatable element 31 fixed with respect to the first support 10 and configured for rotating around a rotation axis perpendicular to the first support 10. The rotatable element 31 comprises a first conversion portion 32. The first conversion portion 32 of FIG. 5 comprises a circular gear element portion 33 whose rotation axis is similar to the rotation axis of the rotatable element 31. The circular gear element portion 33 may be provided with a plurality of inter-engaging teeth on its full circumference. The second conversion portion 35 may comprise another plurality of inter-engaging teeth configured for cooperating with the plurality of inter-engaging teeth of the circular gear element portion 33. The second conversion portion 35 may be shaped according to the desired type of movement of the second support 20 with respect to the first support 10.

The second conversion portion 35 of FIG. 5 has a first portion extending substantially parallel with respect to the lateral side of the second support 20 and a second portion extending at an oblique angle with respect to the first portion in the second support 20 plane. The second conversion portion 35 extends in a similar manner Rotating the rotatable element 31 will cause the circular gear element 33 to cooperate with the linear gear element 36*a*, 36*b* of the first portion of the second conversion portion 32 such that the second support 20 is translated along a first direction with respect to the first support 10. The first translation direction may be decomposed in a translation along a first axis in the movement plane of the second support 20 with respect to the first support 10. Continuing the rotation of the rotatable element 31 in the same direction will cause the circular gear element 33 to cooperate with the linear gear elements 36*a*, 36*b* of the second portion of the second conversion portion 32 such that the second support 20 is translated along a second direction at an oblique angle of the first direction with respect to the first support 10. The second translation direction may be decomposed in a translation simultaneously along the first and a second perpendicular axis in the movement plane of the second support 20 with respect to the first support 10.

A continuous channel 50 in the surface of the second support 20 and extending along a side of the second conversion portion 35 is configured for cooperating with a pin, part of the rotatable element 31, such as to form one or more positioning elements. The channel 50 is bordered by a plurality of marks 52. The plurality of marks 52 acts as a scale to aid the operator position the second support 20 with respect to the first support 10. The plurality of marks may be e.g. printed, engraved, moulded, and/or glued.

As illustrated in FIG. 5, the second support 20 comprises a plurality of lens elements 21 overlying a corresponding plurality of light sources 11 provided to the first support 10. Each lens element 21 of the plurality of lens elements has an internal surface facing a light source 11 of the plurality of light sources and an external surface. The internal surface and/or the external surface may comprise a first curved surface 21*a* and a second curved surface 21*b*, said first curved surface 21*a* being connected to said second curved surface 21*b* through a connecting surface or line comprising a saddle point or discontinuity, through a connecting surface comprising a discontinuity in FIG. 5. The second support 20 is movably arranged relative to the first support 10 to position the light source 11 either in a first position facing the first curved surface 21*a* or in a second position facing the second curved surface 21*b*. The light source 11 may be positioned in any intermediary position between the first position and the second position.

When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. As implemented in FIG. 5, the internal surface comprises a first outwardly bulging surface 21*a*, a second outwardly bulging surface 21*b*, and an internal connecting surface or line connecting said first and second outwardly bulging surfaces 21*a*, 21*b*.

By providing such curved surfaces, the lens element 21 is given a "double bulged" shape allowing to generate distinct lighting patterns depending on the position of the light source 11 with respect to the lens element 21. More in particular, the shape, the size and the location of the light beam may be different depending on the position of the light source 11 with respect to the lens element 21. This will allow illuminating various types of roads or paths with the same luminaire head. Also, this will allow adjusting a lighting pattern in function of the height above the surface to be illuminated.

As illustrated in FIG. 5, the lens element 11 has a circumferential edge in contact with the first support 10, and the internal connecting surface or line is at a distance of the first support 10. The first outwardly bulging surface 21*a* and the first support 11 delimit a first internal cavity, the second outwardly bulging surface 21*b* and the first support delimit a second internal cavity, and the internal connecting surface or line and the first support 10 delimit a connecting passage between the first and second internal cavity. Such a connecting passage will allow a light source 11 to pass from the first to the second cavity and vice versa.

A first width (w1) of the first internal cavity, and a second width (w2) of the second internal cavity are bigger than a third width (w3) of the connecting passage between the first and second internal cavity. The first and second widths extend in the same plane, preferably an upper plane of the first support 10, in a direction perpendicular to the moving direction along the first portion of the second conversion portion 35. The first width is smaller than the second width in the embodiment of FIG. 5. Since the first and second cavities are off-centred one with respect to the other, the third width extend in a plane at an angle relative to the moving direction. The moving means 30 is configured to move the lighting source 11 within the lens element 21 along the length of the first cavity, and simultaneously along the width and length of the second cavity according to the trajectory of the second portion of the second conversion portion 35.

Figure 6A:
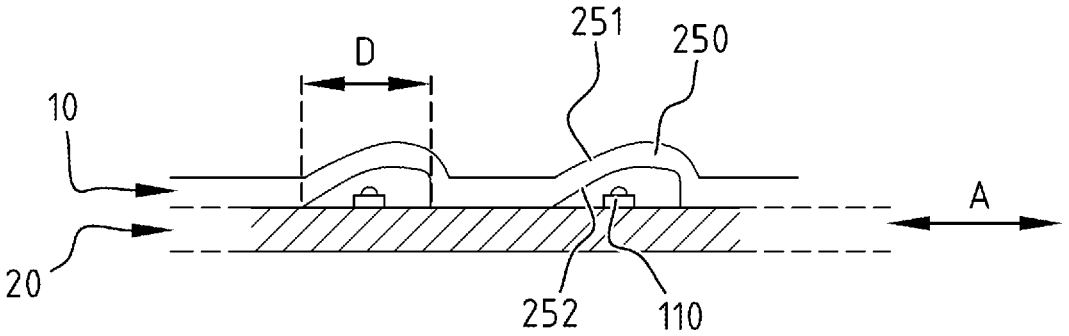
FIGS. 6A-6B illustrate cross-sectional views of other exemplary embodiments of lens elements of a luminaire system.
Figure 6B:
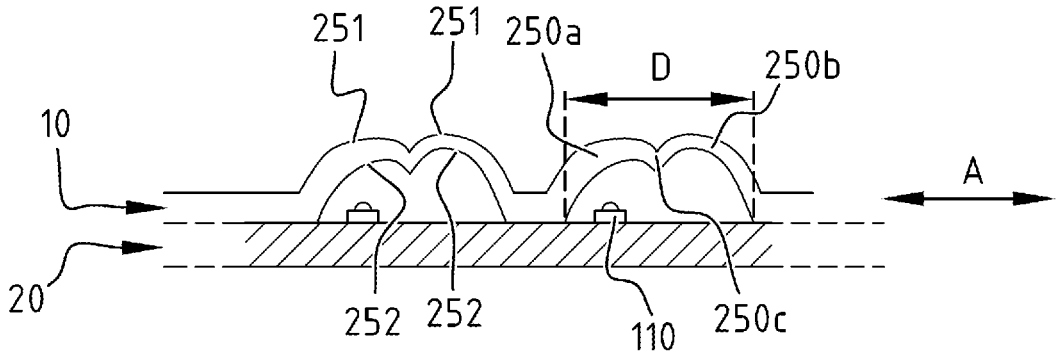

FIGS. 6A-6B illustrate cross-sectional views of other exemplary embodiments of lens elements of a luminaire system.

In the exemplary embodiments of FIGS. 6A-6B, the plurality of light sources 110, in the illustrated embodiments LEDs 110, is mounted on a PCB and the plurality of lens elements 250 is integrated in a lens plate. The lens plate is in contact with the PCB. Each of the plurality of lens elements 250 has a first surface 251 and a second surface 252 facing the plurality of light sources 110 opposite of the first surface 251. The first surface 251 is a convex surface and the second surface 252 is a concave surface. Each lens element of the plurality of lens elements 250 has a varying profile along an internal dimension D in the moving direction of the second support 20, i.e. along the trajectory A. The profile variation may be a shape variation along the internal dimension D of the lens element 250, a thickness variation between the first surface 251 and the second surface 252, and/or a variation of transparency and/or diffusivity and/or reflectivity and/or refractivity. In the embodiments of FIGS. 6A-6B, the trajectory A corresponds to a straight line along an axis A substantially parallel to the first support 10. In other embodiments, the trajectory A may correspond to a curved line substantially parallel to the first support 10.

In the exemplary embodiment of FIG. 6A, the luminaire system comprises a second support 20 comprising a plurality of light sources 110, and a first support 10 comprising a plurality of lens elements 250 associated with the plurality of light sources 110. The first support 10 may be fixed, and the second support 20 is movable with respect to the first support 10 along a trajectory A substantially parallel to the first support 10. A lens element of the plurality of lens elements 250 has a symmetry axis in the movement direction of the second support 20 along the trajectory A. The lens element 250 has a profile varying in thickness seen in the movement direction of the second support 20. The varying profile presents an asymmetric shape with respect to a centre plane perpendicular to the movement direction of the second support 20. Moving the lens plate to position the plurality of lens elements 250 in a plurality of positions will result in a plurality of lighting patterns on a surface, said plurality of lighting patterns having a plurality of different illuminated surface areas.

In the exemplary embodiment of FIG. 6B, the luminaire system comprises a first support 10 comprising a plurality of light sources 110, and a second support 20 comprising a plurality of lens elements 250 associated with the plurality of light sources 110. The first support 10 may be fixed, and the second support 20 is movable with respect to the first support 10 along a trajectory A substantially parallel to the first support 10. A lens element of the plurality of lens elements 250 has a first profile part 250*a* and a second profile part 250*b* adjoined in a discontinuous manner. In other words, the first profile part 250*a* and the second profile part 250*b* are connected through a connecting surface or line 250*c* comprising a saddle point 253 or discontinuity. The first profile part 250*a* presents a shape and a thickness variation along its length. The second profile part 250*b* presents a bell shape and a constant thickness along its length. Moving the plurality of light sources 110 such that the plurality of light sources 110 corresponds to the first profile part 250*a* or the second profile part 250*b* may further modify the lighting pattern obtained from the luminaire system. In the illustrated embodiment of FIG. 6B, the internal dimension D is defined as the added dimensions of the first and second profile part 250*a*, 250*b* on a side facing the plurality of light sources 110 along the movement direction of the second support 20. The second support 20 is movably arranged relative to the first support 10 to position the light sources 110 either in a first position facing the first profile part 250*a* or in a second position facing the second profile part 250*b*. Preferably, each lens element 250 has a circumferential edge in contact with the first support 100, and the connecting surface or line 250*c* is at a distance of the first support 10. Preferably, the first profile part 250*a* is at a first maximal distance of the first support 10, the second profile part 250*b* is at a second maximal distance of the first support 10, and the saddle point or discontinuity 253 is at a third distance of the first support 10, said third distance being lower than said first and second distance. More preferably, the first and second maximal distances are different.

FIGS. 7A-7E illustrate in more detail another embodiment of a "double bulged" lens element suitable for use in embodiments of the invention. The lens element 210 of FIGS. 7A-7E has an internal surface 210*b* facing a light source 110 and an external surface 210*a*. The internal surface 210*b* comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. The external surface 210*a* comprises a first curved surface 211*a* in the form of a first outwardly bulging surface and a second curved surface 212 in the form of a second outwardly bulging surface. The first curved surface 211*a* is connected to the second curved surface 212*a* through an external connecting surface or line 213*a* comprising a saddle point or discontinuity. The second support 20 is movable relative to said first support 10 such that the light source 110 can be in at least a first position P1 facing the first curved surfaces 211*a*, 211*b* or in at least a second position P2 facing the second curved surfaces 212*a*, 212*b*. The lens element 210 has a circumferential edge 218 in contact with the first support 10, and the internal connecting surface or line 213*b* is at a distance of the first support 10. In other words the lens element 210 moves in contact with the first support 10, and the distance between the internal connecting surface or line 213*b* and the first support allows the light source to pass underneath the connecting surface or line 213*b* when the second support 20 is moved from a first position where the light source 110 faces the first curved surfaces 211*a*, 211*b* to a second position where the light source 110 faces the second curved surfaces 212*a*, 212*b*. As is best visible in FIG. 7B, the external connecting surface 213*a* comprises a "line" portion in a central part, and two "surface" portions on either side of the "line" portion. Optionally, the external connecting surface 213*b* may be covered partially with a reflective coating, e.g. the hatched "surface" portions in the top view of FIG. 7B may be provided with a reflective coating.

Figure 7A:
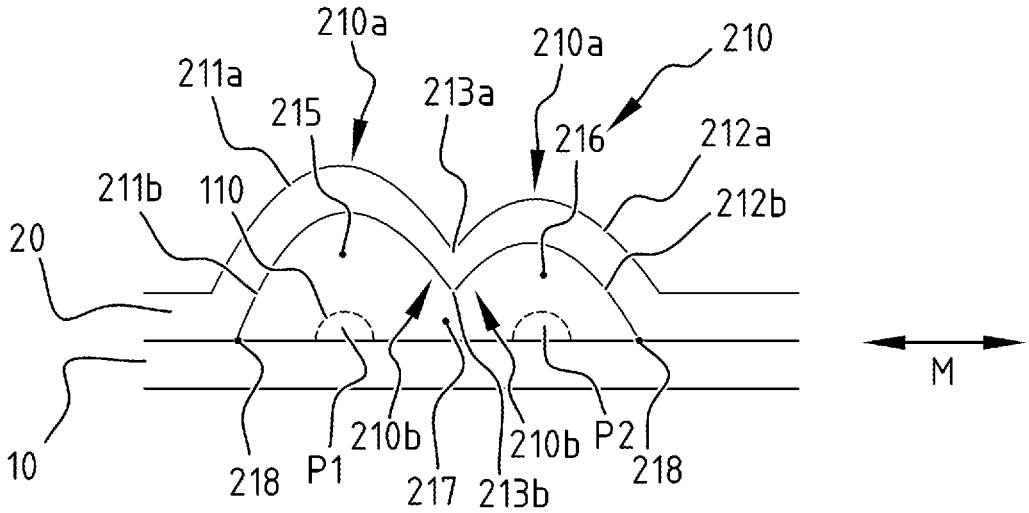
FIG. 7A shows a schematic cross-sectional view of another exemplary embodiment of a lens element.
Figure 7B:
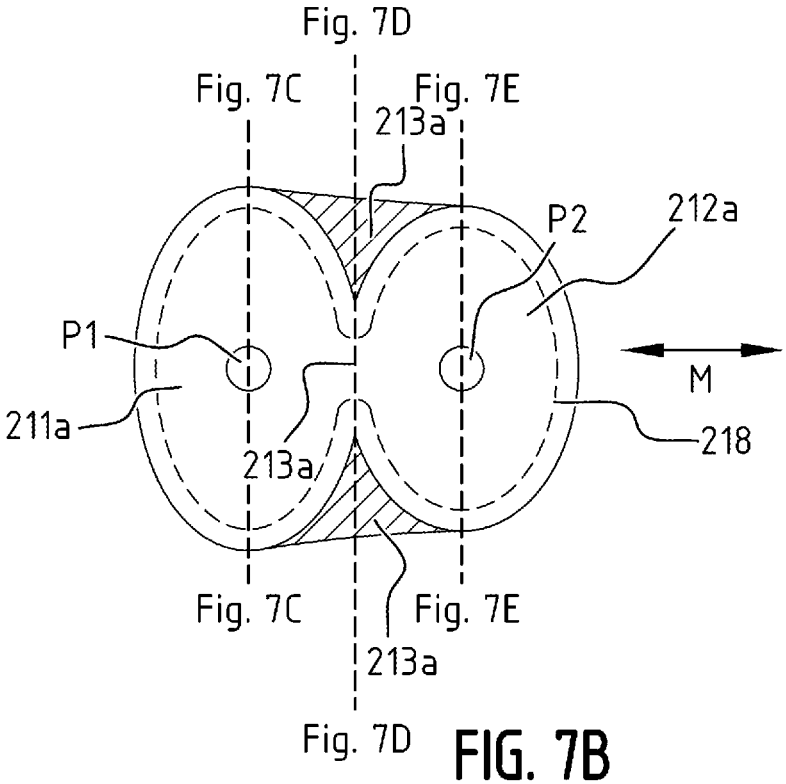
FIG. 7B shows a schematic top view of the lens element of FIG. 7A.
Figure 7C:
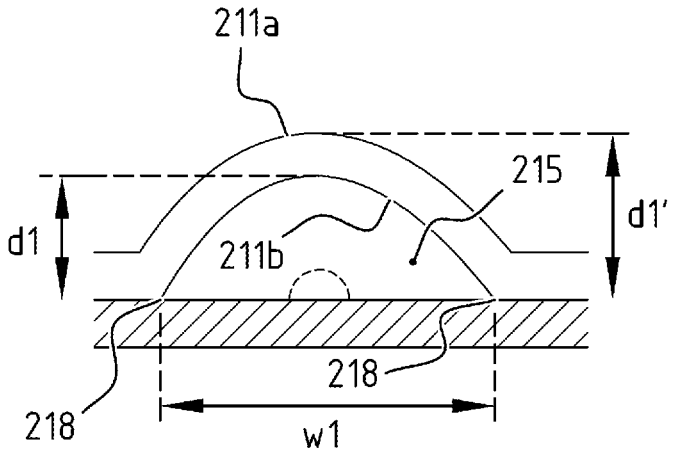
FIGS. 7C-7E are schematic cross-sectional views of the lens element along lines 7C-7C, 7D-7D, 7E-7E shown in FIG. 7B.
Figure 7D:
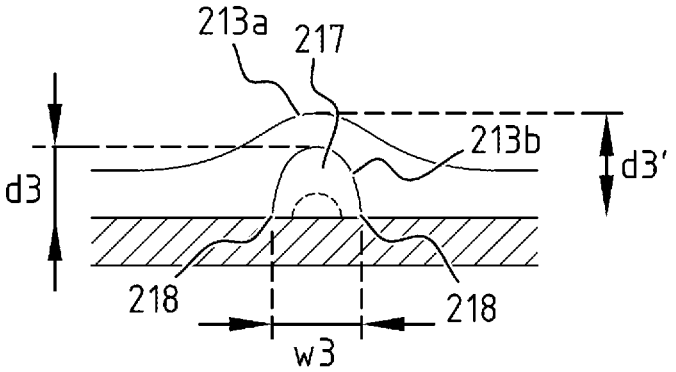
Figure 7E:
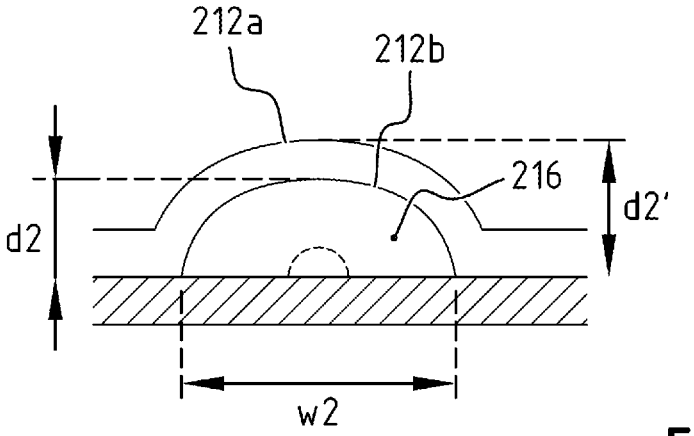

The first outwardly bulging surface 211*b* and the first support 10 delimit a first internal cavity 215, the second outwardly bulging surface 212*b* and the first support 10 delimit a second internal cavity 216, and the internal connecting surface or line 213*b* and the first support 10 delimit a connecting passage 217 between the first and second internal cavity. FIG. 7C shows a cross section along line 7C-7C in FIG. 7B, and illustrates that the first internal cavity 215 has a first maximal width w1, said first maximal width extending in a direction perpendicular on the moving direction M and measured in an upper plane of the first support 10. Similarly, FIG. 7D shows a cross section along line 7D-7D in FIG. 7B, and illustrates that the second internal cavity 216 has a second maximal width w2. FIG. 7E shows a cross section along line 7E-7E in FIG. 7B, and illustrates that the connecting passage 217 has a third minimal width w3. The first maximal width w1 and the second maximal width w2 are preferably larger than the third width w3. Also, the first maximal width w1 and the second maximal width w2 may be different. The first outwardly bulging surface 211*b* is at a first maximal distance d1 of the first support 10, the second outwardly bulging surface 212*b* is at a second maximal distance d2 of the first support 10, and the internal saddle point or discontinuity is at a third minimal distance d3 of the first support 10. The third minimal distance d3 may be lower than said first and second maximal distance d1, d2. Preferably, the first and second maximal distance d1, d2 are different. Similarly, the first outwardly bulging surface 211*a* is at a first maximal distance d1' of the first support 10, the second outwardly bulging surface 212*a* is at a second maximal distance d2' of the first support 10, and the external saddle point or discontinuity is at a third minimal distance d3' of the first support 10. The third minimal distance d3' may be lower than the first and second maximal distance d1', d2'. Preferably, the first and second maximal distance d1', d2' are different.

Whilst the principles of the invention have been set out above in connection with specific embodiments, it is to be understood that this description is merely made by way of example and not as a limitation of the scope of protection which is determined by the appended claims.

The invention claimed is:

1. A luminaire system comprising:

a first support;

a second support movable with respect to said first support;

a moving means configured to move the second support relative to the first support in a movement plane substantially parallel to the first support;

wherein the moving means comprises:

a rotatable element provided to one of the first support or second support and configured for rotating around a rotation axis perpendicular to the movement plane; and wherein the rotatable element comprises a first conversion portion cooperating with a second conversion portion, said second conversion portion provided to the other one of the first support or second support;

wherein the first and second conversion portion are configured for converting a rotational movement of the rotatable element into a movement of the second support with respect to the first support in said movement plane;

wherein the movement of the second support with respect to the first support is a translational movement;

wherein a plurality of light sources is arranged on one of the first support and the second support, and is configured to emit light through one or more optical elements associated with the plurality of light sources and arranged on the other one of the first support and the second support such that the light distribution of the luminaire system will be altered as the second support is translated with respect to the first support, said translation of the second support with respect to the first support causing a translation of the one or more optical elements.

2. The luminaire system according to claim 1, wherein the first support comprises said plurality of light sources and the second support comprises the one or more optical elements associated with the plurality of light sources.

3. The luminaire system according to claim 1, wherein the rotatable element extends through the second support, and the rotation axis is fixed with respect to the first support.

4. The luminaire system according to claim 1, further comprising one or more positioning elements; wherein the moving means is configured for cooperating with the one or more positioning elements to position the second support with respect to the first support in a plurality of predetermined positions.

5. The luminaire system according to claim 4, wherein the one or more positioning elements comprises one or more depressions or protuberances cooperating with at least one corresponding depression or protuberance provided to the moving means.

6. The luminaire system according to claim 1, further comprising a guiding means configured for guiding the movement of the second support with respect to the first support.

7. The luminaire system according to claim 1, wherein the first conversion portion comprises a circular gear element portion, and the second conversion portion comprises a linear gear element portion, preferably extending along the movement direction of the moving means, cooperating with the circular gear element portion.

8. The luminaire system according to claim 1, wherein the first conversion portion comprises an eccentric element, and the second conversion portion comprises a guiding element cooperating with the eccentric element.

9. The luminaire system according to claim 8, further comprising a guiding means configured for guiding the movement of the second support with respect to the first support, wherein the guiding means comprises a plurality of elongated guiding holes located in the first or second support, and wherein the guiding element comprises a hole in the second support within which a portion of the eccentric element is located, and the plurality of elongated guiding holes is extending in a direction perpendicular to the extending direction of the hole of the guiding element.

10. The luminaire system according to claim 1, wherein the first or second support comprises an optical plate integrating the one or more optical elements.

11. The luminaire system according to claim 1, wherein the plurality of light sources is arranged in a two-dimensional array of at least two rows and at least two columns; and/or wherein the one or more optical elements comprises a plurality of lens elements associated with the plurality of light sources.

12. The luminaire system according to claim 11, wherein a lens element of the plurality of lens elements has an internal dimension D seen in the movement direction of the moving means; and wherein the moving means is configured to move the second support with respect to the first support over a distance below 90% of the internal dimension D of the lens element, preferably below 50% of the internal dimension D of the lens element.

13. The luminaire system according to claim 1, wherein the moving means further comprises an actuation element configured for being actuated such that the rotational movement of the rotatable element is achieved.

14. The luminaire system according to claim 13, wherein the actuation element comprises a ferromagnetic material or a magnet element arranged such that the actuation element can be moved by means of a magnet element or a ferromagnetic material arranged outside a compartment of the luminaire system.

15. The luminaire system according to claim 1, further comprising a stopping means configured to stop the movement of the second support with respect to the first support past a predetermined point along at least one movement direction of the moving means.

16. The luminaire system of claim 1, wherein the moving means comprises a rotating actuator; and further comprises a controlling means configured to control the moving means, such that the movement of the second support with respect to the first support is controlled.

17. A luminaire systems network comprising a plurality of luminaire systems according to claim 16 and a remote device; wherein the remote device is configured to send lighting data to each luminaire system; wherein each luminaire system is configured for receiving the lighting data, and the respective controlling means is further configured for controlling the moving means based on the received lighting data.

18. A luminaire system comprising:

a first support;

a second support movable with respect to said first support;

a moving means configured to move the second support relative to the first support in a movement plane substantially parallel to the first support;

wherein the moving means comprises:

a rotatable element provided to one of the first support or second support and configured for rotating around a rotation axis perpendicular to the movement plane; and wherein the rotatable element comprises a first conversion portion cooperating with a second conversion portion, said second conversion portion provided to the other one of the first support or second support;

wherein the first and second conversion portion are configured for converting a rotational movement of the rotatable element into a translational movement of the second support with respect to the first support in said movement plane;

wherein a plurality of light sources is arranged on one of the first support and the second support, and is configured to emit light through a plurality of free-form lens elements associated with the plurality of light sources and arranged on the other one of the first support and the second support, said plurality of free-form lens elements having a varying profile along the translational movement direction of the second support with respect to the first support such that, when translated, the light distribution of the luminaire system is altered.

* * * * *